US011679846B2

(12) United States Patent
Miller

(10) Patent No.: US 11,679,846 B2
(45) Date of Patent: Jun. 20, 2023

(54) FINS WITH IMPROVED FLUID DYNAMIC PROPERTIES

(71) Applicant: Flying Fin Systems Pty Ltd, Margaret River (AU)

(72) Inventor: Glenndin George Miller, Margaret River (AU)

( * ) Notice: Subject to any disclaimer, the term of this patent is extended or adjusted under 35 U.S.C. 154(b) by 156 days.

(21) Appl. No.: 17/189,284

(22) Filed: Mar. 2, 2021

(65) Prior Publication Data

US 2021/0179236 A1 Jun. 17, 2021

Related U.S. Application Data

(63) Continuation of application No. 16/493,621, filed as application No. PCT/AU2018/050236 on Mar. 14, 2018, now Pat. No. 10,967,938.

(30) Foreign Application Priority Data

Mar. 14, 2017 (AU) ..... 2017900890

(51) Int. Cl.

| | |
|---|---|
| ***B63B 32/66*** | (2020.01) |
| *B63B 35/00* | (2020.01) |
| *B63B 34/26* | (2020.01) |

(52) U.S. Cl.
CPC ..... *B63B 32/66* (2020.02); *B63B 34/26* (2020.02); *B63B 2035/009* (2013.01)

(58) Field of Classification Search
CPC .... B63B 32/66; B63B 34/26; B63B 2035/009
See application file for complete search history.

(56) References Cited

FOREIGN PATENT DOCUMENTS

| | | | | |
|---|---|---|---|---|
| DE | 3425233 A * | 1/1986 | ..... | B63B 3/38 |
| EP | 2774836 A1 * | 9/2014 | ..... | B63B 1/32 |

* cited by examiner

*Primary Examiner* — S. Joseph Morano
*Assistant Examiner* — Jovon E Hayes
(74) *Attorney, Agent, or Firm* — Patshegen IP; Moshe Pinchas

(57) ABSTRACT

A fin for use on a surfboard, the fin comprising: a leading edge, a trailing edge, and a base, the base comprising at least one mount for mounting the fin onto a surfboard; a first and a second outer fin surface which meet along the leading edge and the trailing edge and abut the base; and a first ridge protruding laterally from the first outer fin surface, and/or a second ridge protruding laterally from the second outer fin surface; wherein the shape and configuration of the fin creates an area of lower water pressure around and in front of the fin, as well as disrupting and/or reducing the size of trailing vortices, resulting in additional forward thrust for the board on which the fin is mounted.

15 Claims, 31 Drawing Sheets

(A)

(B)

(C)

(A)

(B)

(A)

(B)

(A)

(B)

(A)

(B)

FINS WITH IMPROVED FLUID DYNAMIC PROPERTIES

TECHNICAL FIELD

The present invention relates to the shape and configuration of a fin, keel, propeller, rudder, or plane on a vessel travelling on or under the water which can create an area of lower pressure around, and in front of it, as well as disrupt and/or reduce the size of trailing vortices resulting in additional forward thrust.

BACKGROUND ART

The following discussion of the background art is intended to facilitate an understanding of the present invention only. The discussion is not an acknowledgement or admission that any of the material referred to is or was part of the common general knowledge as at the priority date of the application.

A surfboard, stand-up paddleboard (SUP), or similar type of board for use in water sports and other activities can be viewed in one sense as a summation of hydrodynamic surfaces. The surface of the bottom of the board in contact with water generates lift and affects speed. More importantly though, it is the fins working in collaboration with rail and bottom contour that most influence the feel of the board when changing direction. Since the form shape of surfboards including the rails and bottom surface has undergone finer and finer adjustments over the past few decades, the largest gains that can still be made to a board's performance is in fin modification.

Predominant factors that influence the effect of the fins include (i) foil shape, and the curve from leading to trailing edge as it changes from base to tip; (ii) template shape, which is the combination of depth, width, and rake that make up the profile of the fin; (iii) stability and flex, which can depend on the materials from which a fin is made; and (iv) fin placement, which comprises tow and camber of the fins, the distance between the fins, and the distance of the fins from the rear of the board.

Foils comprise surfaces which affect lift and drag. Where one surface of a foil is curved and the other, predominantly flat (a 'flat foil'), it takes less effort (drag) for liquid to flow past the flat surface as the path of least resistance than the curved surface. As a result, more water will flow past the flat surface of the foil creating an area of high pressure. Conversely, an area of low pressure is created adjacent to the curved surface of the foil. This difference in pressure creates lift towards the curved side of the foil. The more curve a foil has, the more drag it induces over the curved surface which means that a foil with greater curvature will have more lift at lower speeds. The problem is at higher speeds that additional drag will develop turbulence and stall the flow across the foil. Side fins on a surfboard are usually flat foils which are oriented with the flat face of the foil facing towards the centre or stringer of the board. The resulting pressure differential assists to pull the board fins and rail of the surfboard down into the water. Therefore, thicker, more curved foils are preferred by surfers for slow waves, and flatter, finer foils for faster waves.

Template shape affects stability and control. As an example, fins that are deeper, with a wider base and more rake provide greater stability and control as a result of a relatively large surface area. However, more surface area causes greater drag and slows a board down. As a generalisation known amongst surfers, fins with a greater surface area are more preferred for steep and heavy waves, choppy and irregular conditions, for heavier surfers, and/or surfers with a flowing style. Alternatively, fins with less surface area are more preferred for sloped, clean and glassy waves, for lighter surfers, and/or surfers that exercise extreme and radical manoeuvres.

The flex of a surfboard fin can affect stability in turns. For example, a flexible tip on a fin can dampen or smooth out some of the bite when a surfer changes direction on a surf board. But a stable fin base is crucial to prevent or minimise turbulence which can generate drag and disturb the lift causing loss of fin control, making the board slow and out of control. Less flex can make turns more off a pivot.

'Toe' can be considered in terms of the angle the base of the side fins are pointed in towards the centre of the board relative to the leading edge and trailing edge at the base. 'Cant' can be considered in terms of the angle the body of a fin is set at relative to the bottom surface of the board in a plane perpendicular to the direction of the stringer. Both toe and cant affect the 'angle of attack' of fin foils in their movement through the water. A greater angle forces more water flow around the outside curved surface of the foil at lower speeds making it easier to initiate turns on slower waves. However, too much angle at higher speeds increases turbulence and drag slowing down the board.

Thus, there is a compromise between pursuing the balance and stability such fins, keels, rudders, planes (on a submarine or other vessel), or similar extensions are required to provide, whilst benefiting from any potential forward thrust if possible, but at the same time minimising drag forces as the trade-off for having such an extension travelling through the water off the vessel.

SUMMARY OF THE INVENTION

In a first aspect, the invention provides a fin for use on a surfboard, the fin comprising:

- a leading edge, a trailing edge, and a base, the base comprising at least one mount for mounting the fin onto a surfboard;
- a first outer fin surface and a second outer fin surface which meet along the leading edge and the trailing edge and abut the base;
- a first ridge protruding laterally from the first outer fin surface, and a second ridge protruding laterally from the second outer fin surface.

In a preferred embodiment, the invention provides a fin for use on a surfboard, the fin comprising:

- a leading edge, a trailing edge, and a base, the base comprising at least one mount for mounting the fin onto a surfboard;
- a first and a second outer fin surface which meet along the leading edge and the trailing edge and abut the base; and
- a first ridge protruding laterally from the first outer fin surface, and/or a second ridge protruding laterally from the second outer fin surface,
- wherein the distance of the first ridgeline and/or the second ridgeline to the base is between approximately 1% and 15% of the distance of the base to the tip of the fin.

In a preferred embodiment, the first ridge and/or second ridge protrude from the first outer fin surface and second outer fin surface, respectively, on a plane that is substantially parallel to the base. When the fin is mounted onto a surfboard, the first ridge and/or second ridge protrude from the first outer fin surface and second outer fin surface, respectively, on a plane that is preferably substantially parallel to the adjacent bottom surface of the surfboard.

In a preferred embodiment, first ridge sides form out of the first outer fin surface either side of the first ridge, and second ridge sides form out of the second outer fin surface either side of the second ridge.

The first ridge is preferably on a plane substantially at right-angles to the centreplane of the fin, wherein the centreplane of the fin comprises a plane that passes through the leading edge and trailing edge of the fin.

The second ridge is preferably on a plane substantially at right-angles to the centreplane of the fin, wherein the centreplane of the fin comprises a plane that passes through the leading edge and trailing edge of the fin.

At the crest of the first ridge is preferably a first ridgeline, and at the crest of the second ridge is preferably a second ridgeline.

The first ridgeline is preferably on a plane substantially at right-angles to the centreplane of the fin, wherein the centreplane of the fin comprises a plane that passes through the leading edge and trailing edge of the fin.

The second ridgeline is preferably on a plane substantially at right-angles to the centreplane of the fin, wherein the centreplane of the fin comprises a plane that passes through the leading edge and trailing edge of the fin.

The first ridgeline and second ridgeline are preferably on a plane substantially parallel to the base and/or the adjacent bottom surface of the surfboard to which the fin is mounted. The first ridgeline and/or the second ridgeline preferably comprises a curve, at least adjacent the leading edge and trailing edge.

The first ridge preferably protrudes laterally from the first outer fin surface to a maximum distance from the centreplane of between 4 mm and 50 mm, wherein the centreplane of the fin comprises a plane that passes through the leading edge and trailing edge of the fin. More preferably, the first ridge preferably protrudes laterally from the first outer fin surface to a maximum distance from the centreplane of between 6 mm and 20 mm, even more preferably, between 8 mm and 12 mm. The second ridge preferably protrudes laterally from the second outer fin surface to a maximum distance from the centreplane of between 4 mm and 50 mm, wherein the centreplane of the fin comprises a plane that passes through the leading edge and trailing edge of the fin. More preferably, the second ridge preferably protrudes laterally from the second outer fin surface to a maximum distance from the centreplane of between 6 mm and 20 mm, even more preferably, between 8 mm and 12 mm.

The first ridge side and/or second ridge side, or at least a portion of the first ridge side and/or second ridge side, are substantially flat in one embodiment. In another embodiment, the first ridge side and/or second ridge side, or at least a portion of the first ridge side and/or second ridge side, comprise a curve. Where they comprise a curve, preferably, the first ridge side and/or second ridge side, or at least a portion of the first ridge side and/or second ridge side, are concave. Alternatively or in addition, where they comprise a curve, preferably, the first ridge side and/or second ridge side, or at least a portion of the first ridge side and/or second ridge side, are convex. A ridge side on one side of the first ridgeline or second ridgeline may comprise a different shape to the ridge side on the other side of the ridgeline. For example, amongst others, a ridge side on one side of a ridgeline on the fin of the invention may comprise a concave portion, while the ridge side on the other side of the ridgeline may comprise a flat or convex portion, amongst the multitude of possible combinations.

In a preferred embodiment, the first ridge and/or the second ridge are located adjacent or close to the base. Therefore, when the fin according to the invention is mounted to the bottom surface of a surfboard, the first ridge and/or the second ridge, and adjacent ridge sides will be located close to the surface of the surfboard. Preferably, the first ridge and/or the second ridge are located within 40 mm of the base. More preferably, the first ridge and/or the second ridge are located within 25 mm of the base. In a further embodiment, the first ridge and/or the second ridge are located within 10 mm of the base, wherein measurement from the base is from where the mount meets the outer fin surfaces.

The first ridgeline and/or the second ridgeline are preferably located within 30 mm of the base. More preferably, the first ridgeline and/or the second ridgeline are located within 20 mm of the base. Even more preferably, the first ridgeline and/or the second ridgeline are located within 10 mm of the base, wherein measurement from the base is from where the mount meets the outer fin surfaces.

The first ridge and second ridge are preferably located approximately the same distance (equidistant) from the base, or located approximately the same distance (equidistant) from the tip of the fin, wherein the tip is at the top of the fin at the opposite end to the base where the leading and trailing edges meet.

The length of the first ridge and the second ridge is preferably most or all of the length between the leading edge and the trailing edge of the fin. Alternatively, the length of the first ridge and the second ridge is preferably less than the length between the leading edge and the trailing edge of the fin. That is, each ridge preferably comprises a front end adjacent to the leading edge of the fin, and a rear end adjacent to the trailing edge.

The first ridgeline and/or the second ridgeline may comprise a sharp edge, or may comprise a rounded edge, a squared edge or another shape, or a combination of both a sharp and rounded ridge edge or another shape, along the length of the ridgelines.

In a preferred embodiment of the fin of the invention, the fin comprises a third ridge protruding laterally from the first outer fin surface, and a fourth ridge protruding laterally from the second outer fin surface. The third ridge and fourth ridge are preferably smaller than the first ridge and second ridge. The third ridge and fourth ridge are preferably located approximately the same distance (equidistant) from the base, and the third ridge and fourth ridge are preferably the same size, shape and configuration.

At the crest of the third ridge is preferably a third ridgeline, and at the crest of the fourth ridge is preferably a fourth ridgeline. The third and fourth ridgelines are preferably substantially parallel to the base and/or the adjacent bottom surface of the surfboard to which the fin is mounted. The third ridgeline and/or the fourth ridgeline preferably comprises a curve, at least at one or both ends of the ridgeline.

The third ridge and fourth ridge are preferably substantially parallel to the base and/or the adjacent bottom surface of the surfboard to which the fin is mounted, or the third ridge and fourth ridge may have a slight acute angle of attack towards the base. That is, the end of the third ridge and fourth ridge that is closest to the leading edge may be closer in distance to the base than the end of the third ridge and fourth ridge that is closest to the trailing edge. The 'angle of attack' of the third and/or fourth ridge of the fin (or keel, or plane or other extension from a vessel) towards the base is preferably between 1° and 5°, more preferably between 2° and 3°.

Third ridge sides preferably form out of the first outer fin surface either side of the third ridge, and fourth ridge sides form out of the second outer fin surface either side of the fourth ridge.

The third ridge preferably protrudes laterally from the first outer fin surface by between 2 mm and 40 mm, more preferably, by between 5 mm and 20 mm, even more preferably by between approximately 8 to 12 mm, from the centreplane. The second ridge preferably protrudes laterally from the second outer fin surface by between 2 mm and 40 mm, more preferably, by between 5 mm and 20 mm, even more preferably by between approximately 8 to 12 mm, from the centreplane.

The third ridge sides and/or fourth ridge sides or at least a portion of the third ridge sides and/or fourth ridge sides are flat in one embodiment. In another embodiment, the third ridge sides and/or fourth ridge sides or at least a portion of the third ridge sides and/or fourth ridge sides comprise a curve. Where they comprise a curve, preferably, the ridge sides or a portion of the ridge sides are concave. Alternatively, or in addition, where they comprise a curve, preferably, the ridge sides or a portion of the ridge sides are convex. A ridge side on one side of a ridgeline on the fin of the invention may comprise a different shape to the ridge side on the other side of the ridgeline. For example, amongst others, a ridge side on one side of the third or fourth ridgeline on the fin of the invention may comprise a concave portion, while the ridge side on the other side of the ridgeline may comprise a flat or convex portion, amongst the multitude of possible combinations.

The third ridge is preferably smaller and located further from the base than the first ridge on the first outer fin surface. The fourth ridge is preferably smaller and located further from the base than the second ridge on the second outer fin surface.

The maximum thickness (from a front view) of the fin (or keel, or plane or other extension from a vessel) from the first ridge to the second ridge, and/or from the first ridgeline to the second ridgeline, is preferably between approximately 1.5 to 6 times, more preferably between approximately 2 to 4.5 times, even more preferably, approximately 3 to 3.5 times, thicker than the maximum thickness of the non-ridged portion of the fin (or keel, or plane or other extension from a vessel).

In a preferred embodiment of the fin (or keel, or plane or other extension from a vessel) according to the invention, the first ridge protrudes laterally from the first outer fin surface, and/or the second ridge protrudes laterally from the second outer fin surface, to a maximum distance from the centreplane of between 1.5 to 6 times, more preferably between approximately 2 to 4.5 times, even more preferably, approximately 3 to 3.5 times, greater than the maximum distance of the centreplane to a non-ridged portion of the first outer fin surface, wherein the centreplane passes through the leading edge and trailing edge of the fin. A non-ridged portion of the first outer fin surface is a portion of the fin that does not comprise any lateral or other protrusion from the outer fin surface.

The distance of the first ridgeline to the base, and/or second ridgeline to the base, is preferably between approximately 1% and 30%, more preferably between approximately 2% and 15%, even more preferably between approximately 4% to 8%, of the distance of the base to the tip of the fin (or keel, or plane or other extension from a vessel).

The maximum thickness (from a front view) of the fin (or keel, or plane or other extension from a vessel) from the third ridge to the fourth ridge, and/or from the third ridgeline to the fourth ridgeline, is preferably between approximately 1 to 6 times, more preferably between approximately 2 to 5 times, even more preferably between approximately 3 to 4 times, thicker than the maximum thickness of the non-ridged portion of the fin (or keel, or plane or other extension from a vessel).

In a preferred embodiment of the fin (or keel, or plane or other extension from a vessel) according to the invention, the third ridge protrudes laterally from the first outer fin surface, and/or the fourth ridge protrudes laterally from the second outer fin surface, to a maximum distance from the centreplane of between 1.5 to 6 times, more preferably between 2 to 5 times, even more preferably, between 3 to 4 times, greater than the maximum distance of the centreplane to a non-ridged portion of the first outer fin surface, wherein the centreplane passes through the leading edge and trailing edge of the fin.

The distance between the third ridge and/or fourth ridge to the base (where the fin meets the mount) is preferably between approximately 2% to 30%, more preferably between approximately 5% to 25%, even more preferably between approximately 12% to 18%, of the distance of the base to the tip of the fin.

The third and/or fourth ridge preferably starts approximately one third of the distance of the total fin behind the front of the fin (or keel, or plane or other extension from a vessel). The third and/or fourth ridge preferably ends approximately one third of the distance of the total fin from the end of the fin (or keel, or plane or other extension from a vessel).

The shape of the third and/or fourth ridge of the fin (or keel, or plane or other extension from a vessel) is preferably a substantially a flat foil with a flat upper surface facing away from the base. The maximum height of the third and/or fourth ridge is preferably approximately 1 mm to 20 mm, more preferably 3 mm to 10 mm, even more preferably, between approximately 4 mm to 6 mm.

The portion of the height of the outer fin surfaces of the fin (or keel, or plane or other extension from a vessel) comprising ridges is preferably approximately 10% to 40%, more preferably 20% to 30%, even more preferably 23% to 28% of the total height of the fin from base to tip.

The fin according to the invention may comprise one or more additional ridges protruding from the first and/or the second outer fin surfaces, similar in shape, size, and configuration to those ridges described herein, or different in size, shape, and configuration.

The first and a second outer fin surfaces which meet along the leading edge and the trailing edge and abut the base comprise the ridges described herein preferably protruding from an otherwise predominantly smooth curved surface common to known surfboard fins. Alternatively, the first and/or second outer fin surfaces may not be predominantly smooth curved surfaces but may contain other features, shapes and edges. In some non-limiting examples, the first and/or second outer fin surfaces may comprise flat surfaces at different planes abutting each other along various straight and/or curved edges located between the leading edge and trailing edge; or the first and/or second outer fin surfaces may comprise deformities, organised in a pattern or irregular such as dimples or bumps.

Side Fins

The fin according to the invention as described above is preferably symmetrical along its centreplane, the centreplane comprising a plane that passes through the leading edge and trailing edge, and the fin can be used as a centre fin on a surfboard or other watercraft in line with the centre stringer or centreline of the surfboard. That is, the one or more ridges are the same or substantially identical in shape, size and configuration on the first outer in surface to the one or more ridges on the second outer fin surface.

The fin according to the invention for use as a side fin in, for example, a dual fin, thruster, or quad fin arrangement, amongst other arrangements, may comprise:

(i) the same symmetrical fin as described above;

(ii) an unsymmetrical embodiment of the fin described above on the same or on a different cant; or (iii) a flat foil embodiment of the fin described above on the same or on a different cant.

In an unsymmetrical embodiment of the fin described above, a side fin according to the invention for use in a dual, thruster, quad or other fin arrangement on a surfboard, is preferably asymmetrical along its centreplane, the centreplane comprising a flat plane that passes through the leading edge and trailing edge. Preferably, the position, size and configuration of the first ridge and second ridge is different and not symmetrical along the centreplane of the fin. Preferably, the position, size and configuration of the third and fourth ridges is different and not symmetrical along the centreplane of the fin.

In a flat foil embodiment of the fin according to the invention comprises only a first ridge and/or a third ridge, as described above, protruding laterally from the first outer fin surface. This is to suit, for example, the side fins in a three-fin 'thruster' arrangement which comprise flat foils having one substantially flat outer fin surface facing the centre stringer or centreline of the surfboard.

For the purposes of describing the invention, the first outer fin surface is the right or starboard side of a fin positioned on the right or starboard side of a surfboard, meaning the other port side, comprising a flat outer fin surface, will face towards the centre stringer or centreline of the surfboard. Alternatively, the first outer fin surface is the left or port side of a fin positioned on the left or port side of a surfboard, meaning the other starboard side, comprising a flat outer fin surface, will face towards the centre stringer or centreline of the surfboard.

The benefit of side fins comprising a flat foil configuration are well known in the art and the two flat foils either side of a symmetrical fin are commonly referred to as a 'thruster' arrangement. That is because standard side flat foil fins provide 'lift' or thrust' in a direction perpendicular to the non-flat (curved) side of the fin according to Bernoulli's law. Thus, these side fins are usually positioned with a 'toe' of a few degrees inwards towards the centre of the board so that the resulting lift will be directed slightly forward (if the toe is too high, the lift is cancelled out by greater drag of the angled fin facing the direction of the water) adding a small amount of forward thrust to the surfboard as it is ridden on the surface of a wave.

Detachable and Adjustable Fin

The fin according to the invention may be a non-adjustable ('fixed') fin or may comprise a detachable and/or adjustable fin. The detachable and/or adjustable fin comprises at least a base portion and a fin section, wherein the base portion comprises the mount. The fin section can be removed or uncoupled from the base portion, or reattached or coupled to the base portion. The adjustable fin enables adjustment of the position of the fin section relative to the base portion in a direction towards the leading edge or trailing edge, or in another manner.

In an embodiment of the invention, the fin is an adjustable fin comprising:

a base portion comprising:

a mount for attaching the fin to a surfboard; and an insert member extending in a direction contrary to the mount;

a fin section comprising:

two outer fin surfaces which meet at a leading edge and a trailing edge comprising the first and the second outer fin surfaces;

a first ridge protruding laterally from the first outer fin surface, and/or a second ridge protruding laterally from the second outer fin surface;

an underside surface comprising an opening to an internal cavity within the fin section, the internal cavity within the fin section configured to house the insert member of the base portion and enable slidable movement of the insert member in a direction towards the leading edge or the trailing edge; and a lock that is manipulable, wherein the lock can releasably couple to the insert member at one of two or more locking positions thereby preventing slidable movement of the insert member;

wherein the fin section is configured to adjust relative to the base portion by manipulating the lock to uncouple the lock from the insert member at a first locking position, slidably moving the insert member through the internal cavity, and releasably coupling the lock to the insert member at a second locking position.

In an embodiment of the invention, the fin is a detachable fin comprising:

a base portion comprising:

a mount for attaching the fin to a surfboard; and an insert member extending in a direction contrary to the mount;

a fin section comprising:

two outer fin surfaces which meet at a leading edge and a trailing edge comprising the first and the second outer fin surfaces;

a first ridge protruding laterally from the first outer fin surface, and/or a second ridge protruding laterally from the second outer fin surface;

an underside surface comprising an opening to an internal cavity within the fin section, the internal cavity within the fin section configured to house the insert member of the base portion; and a lock that is manipulable, wherein the lock can releasably couple to the insert member thereby preventing movement of the fin section relative to the base portion;

wherein the fin section is uncoupled from the base portion by manipulating the lock to uncouple the lock from the insert member, and the fin section is coupled to the base portion by manipulating the lock to couple the lock to the insert member.

Preferably the lock projects into the internal cavity. More preferably, the lock is manipulated from an outer fin surface. The lock can preferably be manipulated from the first and/or second outer fin surface. More preferably, the third and/or fourth ridge incorporates the lock. The lock preferably comprises at least one knob accessible for a user at the first and/or second outer fin surface for manipulating the lock, and turning the knob uncouples or recouples the lock from the insert member. The knob can preferably be finger turned by a user, for example, while in the water and without the requirement of any tools. More preferably, the knob is located within the third and/or fourth ridge, and the knob has an exterior surface, and a portion of the exterior surface of the knob lies flush with the third and/or fourth ridge and ridge sides of the third and/or fourth ridge when the lock is coupled to the insert member.

The insert member is preferably substantially planar. The insert member preferably comprises two or more teeth, and a valley between two teeth forms a locking position. The two or more teeth are preferably located at an end of the insert member. The two or more teeth preferably point in a direction substantially contrary to the mount.

The lock preferably comprises a locking portion which is received at a locking position in a valley thereby coupling the lock to the insert member, and turning the knob moves the locking portion out of the valley and the locking position, thereby uncoupling the lock from the insert member and enabling slidable movement of the insert member through the internal cavity. Following slidable movement of the insert member through the internal cavity, re-turning the knob can preferably move the locking portion into the same or a different valley and a locking position, thereby recoupling the lock to the insert member.

A portion of the internal cavity and the insert member are preferably configured to form a sliding joint which also couples the fin section to the base portion. More preferably, the sliding joint is a sliding dovetail joint.

Dual Fin

In a further embodiment of the fin according to the invention, a second fin section is preferably attached to the fin (or fin section of an adjustable and/or detachable fin) according to the invention as described above by one or more attachment means. Attachment means may, in some non-limiting examples, comprise rods, plates, pins, bars, and/or be formed from a portion of either the fin or the second fin section. More preferably, the one or more attachment means comprise one or more ribs. The one or more attachment means preferably preserve a minimum distance between the fin and the second fin section of between approximately 0.25 mm and 5 mm. The one or more attachment means more preferably preserve a minimum distance between the fin and the second fin section of approximately 1 mm. The attachment means preferably reduce or remove any fluttering effect on either the fin or second fin section caused by water passing around and between the fin and the second fin section.

The second fin section is preferably positioned substantially parallel to the fin and offset such that the leading edge of the second fin section is not aligned with the leading edge of the fin. The second fin section preferably comprises a flat foil having a substantially flat outer fin surface, and a curved outer fin surface. In a preferred embodiment, the leading edge of the fin is in a position forward of the leading edge of the second fin section. Preferably, the leading edge of the fin is forward of the leading edge of the second fin section by approximately 5 mm to 15 mm, and more preferably by approximately 10 mm.

The second fin section preferably comprises at least one passage through which water can pass. The passage comprises an opening on each outer fin surface of the second fin section through which water can enter and exit. The passage preferably comprises an opening on the substantially flat outer fin surface, and an opening on the curved outer fin surface, and the opening on the curved outer fin surface is located between the trailing edge of the second fin section and the minimum distance between the fin and the second fin section. Preferably, the opening of the passage on the substantially flat outer fin surface of the second fin section is located closer to the leading edge of the second fin section than the opening of the passage on the curved outer fin surface of the second fin section, wherein water can enter the opening on the substantially flat outer fin surface, pass through the passage, and exit through the opening on the curved outer fin surface. A passage through the second fin section and/or an opening is preferably not round or another shape that would cause water passing through the passage to form a vortex. The openings and passages may be created from drilling or cutting holes or perforations through the second fin section or from the shape of a mould used to make the fin.

A dual fin according to the invention is preferably mounted in the position of a side fin on a surfboard wherein:

- the second fin section comprises a flat foil having a substantially flat outer fin surface facing the centre or stringer of the surfboard, and a curved outer fin surface facing the adjacent rail of the surfboard;
- the fin is in a position closer to the adjacent rail of the surfboard than the second fin section; and
- the leading edge of the fin is positioned closer to the front of the board than the leading edge of the second fin section.

In a preferred embodiment, the second fin section comprises at least one passage comprising an opening on the substantially flat outer fin surface, and an opening on the curved outer fin surface of the second fin section through which water can pass. When the dual fin of the invention is mounted to a surfboard which is moving in a substantially forward direction through water during normal use, the at least one passage in the second fin section is preferably configured to:

- enable water to enter an opening on the substantially flat outer fin surface of the second fin section, pass through the passage, and exit through an opening on the curved outer fin surface in a location between the trailing edge of the second fin section and the position of the minimum distance between the fin and the second fin section; and
- substantially prevent water passing in the reverse direction through the passage.

The openings preferably comprise holes or perforations on the surface of the substantially flat and curved outer fin surfaces of the second fin section through which water can enter and exit, respectively. Preferably, the opening on the substantially flat outer fin surface of the second fin section is positioned closer to the leading edge than the opening on the curved outer fin surface.

The second fin section may be the same size, shape, and configuration, or a different size, shape and configuration, to the fin. The second fin section may have a different fin template to the fin. Preferably, the size and template of the second fin section is smaller than the fin and is positioned above the one or more lateral ridges on the fin.

Two or more dual fins according to the invention may be mounted to a surfboard.

Alternatively, a third fin section may be attached to a fin according to the invention on the other outer fin surface not attached to the second fin section. This fin comprising the second and third fin sections may be symmetrical and be used as a centre fin on a surfboard.

In another embodiment, two or more fins according to the invention may be joined together.

Mount

The mount or 'mounting means' for a fin of the invention as herein described, may comprise a variety of means known for mounting or attaching a fin to a surfboard or another board.

In a preferred embodiment of an adjustable fin of the invention, the mount comprises one or more mounting blocks for attaching to one or more surfboard fin plugs and/or fin boxes. The one or more mounting blocks are preferably compatible with, and capable of attaching to commercially available fin plug and/or fin box systems. Preferably, the one or more mounting blocks can be mounted to commercially available FCS® fin plugs and/or Futures® fin boxes.

In another preferred embodiment, the mount comprises a base attachment surface which is directly and fixedly secured to the external bottom surface of the surfboard with adhesive and/or screw type fasteners as described herein. The adhesive is preferably Araldite®, marine silicon, or another epoxy or non-latex construction silicone adhesive that can maintain an adhesive connection between a fin of the invention and a surfboard or another board, particularly when exposed to water. The marine silicon may provide up to, or greater than 600% elongation ability thereby providing a bond between the fin of the invention and a surfboard on to which it is mounted, which will unlikely break even under the forces of a heavy surfer turning sharply and quickly on a heavy wave. The base attachment surface preferably provides recesses or cavities of a size sufficient to accommodate the adhesive to provide such a bond between the surfboard and the fin.

Preferably, one or more screws or screw type fasteners secure a base attachment plate comprising at the base attachment surface to the surfboard and preferably in combination with adhesive. The one or more screws may be secured to the surfboard at a variety of different positions through the base attachment plate. Preferably, the screws are placed at least in front of the leading edge of the fin, behind the trailing edge, and adjacent to each outer fin surface. The screws may be secured to the surfboard through holes in the base attachment plate through which adhesive is injected. The screws can preferably be turned with a hex or Allen key and screw plugs, for example, plastic screw plugs, may be pre-set in the surfboard into which the screws can be driven and embedded to secure the base of the fin to the surfboard.

In another embodiment, the base attachment surface may be 'fiberglassed' onto the surfboard using traditional 'glassing' methods known in the art. For example, comprising placing 'rovings' around the outer edge or border of the base attachment surface.

Gap

A gap may be created between the base of the fin (or underside surface of the base) and the surfboard onto which the fin is mounted. In this respect, the fin according to the invention can comprise one or more gaps between the base of the fin and the surfboard onto which it is mounted. These gaps may vary in shape, size, and height between surfboard and base, according to the desired vortices to be created around the fin as water passes the fin according to the invention.

The height of the gap between the base of the fin and the external outer surface of the surfboard is preferably between approximately 0.5 mm and 25 mm. The height of the gap is more preferably between approximately 5 mm and 20 mm. The height of the gap is more preferably approximately 15 mm. The height of the gap for a surfboard fin or other type of fin, for example, a keel, is preferably between 1% and 20%, more preferably between 2% and 10%, even more preferably between 2.5% and 7.5%, of the total height of the fin/keel, etc. from base to tip.

Safety

For the purpose of maintaining the safety of users of one or more fins of the invention on a surfboard, the fin preferably comprises a weak portion adjacent the base and mount or on the base portion for the adjustable and/or detachable fin. The weak portion comprises a portion of the fin that can more easily be broken than the remaining portion of the fin. Under strong forces acting on a fin of the invention, for example, heavy contact of: a reef, the surfer, another surfer, another board, or rocks, amongst others, the fin can break at the weak portion. The purpose of the breakage is to reduce the potential damage to the person the fin comes into contact with, or reduce or minimise damage to the board to which the fin is mounted which can occur if a fin gets torn out of the board due to catching on a reef or rock, as some non-limiting examples.

A further safety feature is the overmolding of flexible polymer over titanium alloy fin portions, when used, to prevent sharp leading and tailing edges from being a danger to the surfer or other nearby persons in the water.

Board Type

The fin of the invention as herein described, may be mounted to any one of the boards in the group comprising: surfboard, shortboard, kneeboard, longboard, minimal, soft board, kiteboard or a board used for kite surfing, wind surfer, stand up paddleboard, wakeboard, rescue board, bodyboard, or another board used in surface water sports or activities. Reference herein to a 'surfboard' can also include reference to any one of these other boards.

Fin Arrangement

More than one fin of the invention may be mounted to a surfboard. For example, a thruster fin setup on a surfboard may comprise up to three fins of the invention as described herein. Alternatively, a single fin or a quad fin setup comprising fins of the invention may be mounted on to a surfboard. In some non-limiting examples, a fin arrangement may comprise:

- Three fins according to the invention in a three-fin 'thruster' arrangement;
- Two non-adjustable (fixed) side fins according to the invention, and an adjustable version of a centre fin according to the invention, in a three-fin 'thruster' arrangement;
- Two adjustable or non-adjustable (fixed) side fins according to the invention and a standard centre fin in a three-fin 'thruster' arrangement;
- Two standard side fins and an adjustable version of a centre fin according to the invention in a three-fin 'thruster' arrangement; or
- An adjustable or non-adjustable (fixed) centre fin according to the invention with no side fins in a 'single fin' arrangement;

amongst many other such possible fin arrangements.

Various combinations are therefore possible for using fins of the invention as described herein, exclusively, or in combination with existing standard fins or other types of fins on a surfboard.

The overall side template profile of a fin according to the invention will preferably resemble a standard surfboard fin shape as known in the art.

Process for Mounting a Fin of the Invention

The present invention further provides a process of mounting a fin of the invention as herein described, to any one of the boards in the group comprising: surfboard, shortboard, kneeboard, longboard, minimal, soft board, kiteboard, wind surfer, stand up paddleboard, wakeboard, rescue board, bodyboard, or another board used in surface water sports or activities. The present invention also provides a process of mounting a fin of the invention to a surfboard by mounting the fin using a mount as described herein.

Process for Manufacturing a Fin of the Invention

The present invention also provides a process of manufacturing a fin according to the invention as described herein. The fin of the invention is preferably constructed from common materials known to be used to make surfboard fins including: plastics, recycled plastics, carbon fibre, fiberglass, texalium, glass epoxy laminate, Kevlar™ carbon, resin composite material, polycarbonates, and/or from other materials described herein.

In one embodiment of the invention, a portion of, or the entire fin is constructed from, or comprises, a metal or a metal alloy. The metal is preferably strong, light weight, and incapable of rusting or significant corrosion.

In a preferred embodiment, the metal is titanium. Preferably, the metal is a titanium alloy. More preferably, the titanium alloy comprises between approximately 3.5% to 4.5% vanadium, and between approximately 5.5% to 6.75% aluminium. Evan more preferably, the titanium alloy comprises approximately 4% vanadium and approximately 6% aluminium. This titanium alloy can provide beneficial flex characteristics for a surfboard fin constructed wholly or almost wholly from this material. The titanium alloy in the fin section preferably comprises holes or cut outs of the same or various sizes which can further reduce the weight of the fin and increase the flex characteristics of the fin. The titanium or titanium alloy is preferably encased within a flexible polymer overmold by the process of overmolding. The overmolding may be molded to cover the shape of the titanium alloy fin, or may form a larger portion of a fin which contains within it a titanium alloy fin portion.

Use of the titanium alloy in the fin of the invention enables a thinner fin to be constructed. Where a commercially available shortboard fin may be 7 mm to 8 mm thick at its thickest point on the fin section, the titanium alloy fin is preferably between approximately 1.5 mm and 3 mm thick, and more preferably between 2 mm and 2.5 mm thick, at its widest point (base and mount excluded). With the overmolding over the titanium alloy, the fin is preferably between approximately 2.5 mm and 4 mm thick, and more preferably between 3 mm and 3.5 mm thick at its widest point.

In another embodiment, the whole fin, or a portion of the fin comprises dust or flakes of: titanium, or titanium alloy comprising approximately 4% vanadium and approximately 6% aluminium.

Alternatively, the metal is aluminium. The fin may be formed in one part or from two halves joined together or from more components.

Similarly to the large number of different fins currently available for mounting to a surfboard or another type of board described herein, the upper portion of the fin according to the invention above the ridges can comprise a variety of different: shapes or templates or even cants; outer fin surface shapes or features; sizes; types of foils; colours; materials from which the fin section is constructed; rakes; depths; widths; cants; cut-outs; and other designs and extensions including channels, 'tunnels' and 'wings', amongst others. In this regard, a user can select and mount a fin of the invention to a board with attributes that is desired by the user or suitable for the user's requirements and appropriate for the board the fin or fins are mounted on.

Other Applications

The shape and configuration of the fin according to the invention has benefits in disrupting vortices and increasing forward thrust for surface watercraft including surfboard fins as herein described. These benefits can also be advantageous for other vessels that travel through water. Thus, this shape and configuration is applicable for such extensions on these other types of vessels including for the examples provided as follows.

Keels

In a second aspect, keels on yachts, catamarans, and other boats; hydrofoils on vessels including boats and surfboards, and fins on kayaks and canoes, may comprise the shape and configuration of one or more of the ridges described for the fin of the invention. Similar to the surfboard fin, the configuration would provide benefit from: creating a vortex due to the surfaces of (i) the hull of the boat, (ii) the lower main ridge surface (adjacent the hull), and (iii) the minor third and fourth ridges, working in concert; therein creating a region of lower water pressure around the keel and in front of the keel; and disruption and/or reduction of the size of the trailing vortices behind the keel (and an area of higher pressure to 'push' against'); which lead to thrust towards the area of lower pressure in front of the keel. The result, is an overall increase in forward velocity for the boat or other vessel when compared to a keel without the ridges described herein. On a hydrofoil including a hydrofoil surfboard, the ridges of the invention may be positioned, for example, amongst others, at or adjacent the base of the hydrofoil to reduce drag in the region where the hydrofoil meets the underwater wing at the opposite end to the end of the hydrofoil connecting the surfboard.

Planes, Rudders, Ducts

Submarines, submersibles, (underwater) diver propulsion vehicles, and similar underwater vessels comprise fins, planes, rudders and ducts at various positions on the hull and/or conning tower (where applicable) to assist stability as these vessels move through water. These fins, planes, rudders, and ducts often have a cross-section similar to a plane wing or comprise an elliptical or flat (planar) cross-section. In this respect, these planes and other extensions may comprise the shape and configuration of one or more of the ridges described for the fin of the invention to: provide the benefits from creating an area of lower pressure in front of and at the planes and other extensions, while disrupting trailing vortices immediately behind them, resulting in additional thrust in a forward direction than when compared to the absence of the ridges.

Propellers and Impellers

In a third aspect of the invention, propellers and impellers may also comprise the shape and configuration of the ridges described for the first or second aspects of the invention to provide the benefits from creating an area of lower pressure in front of and at the propellers and impellers, while disrupting trailing vortices immediately behind them, resulting in additional thrust in a forward direction than when compared to the absence of the ridges.

BRIEF DESCRIPTION OF DRAWINGS

The present invention will now be described, by way of example, with reference to the accompanying drawings, in which.

DESCRIPTION OF PREFERRED EMBODIMENTS

Those skilled in the art will appreciate that the invention described herein is susceptible to variations and modifications other than those specifically described. It is to be understood that the invention includes all such variations and modifications. The invention also includes all of the steps, features, compositions and compounds referred to or indicated in the specification, individually or collectively and any and all combinations or any two or more of the steps or features.

The present invention is not to be limited in scope by the specific embodiments described herein, which are intended for the purpose of exemplification only. Functionally equivalent products, compositions and methods are clearly within the scope of the invention as described herein.

Throughout this specification, unless the context requires otherwise, the word "comprise", or variations such as "comprises" or "comprising", will be understood to imply the inclusion of a stated integer or group of integers but not the exclusion of any other integer or group of integers.

Other definitions for selected terms used herein may be found within the detailed description of the invention and apply throughout. Unless otherwise defined, all other scientific and technical terms used herein have the same meaning as commonly understood to one of ordinary skill in the art to which the invention belongs.

Features of the invention will now be discussed with reference to the following preferred embodiments.

Surfboard Fins

Figure 1:
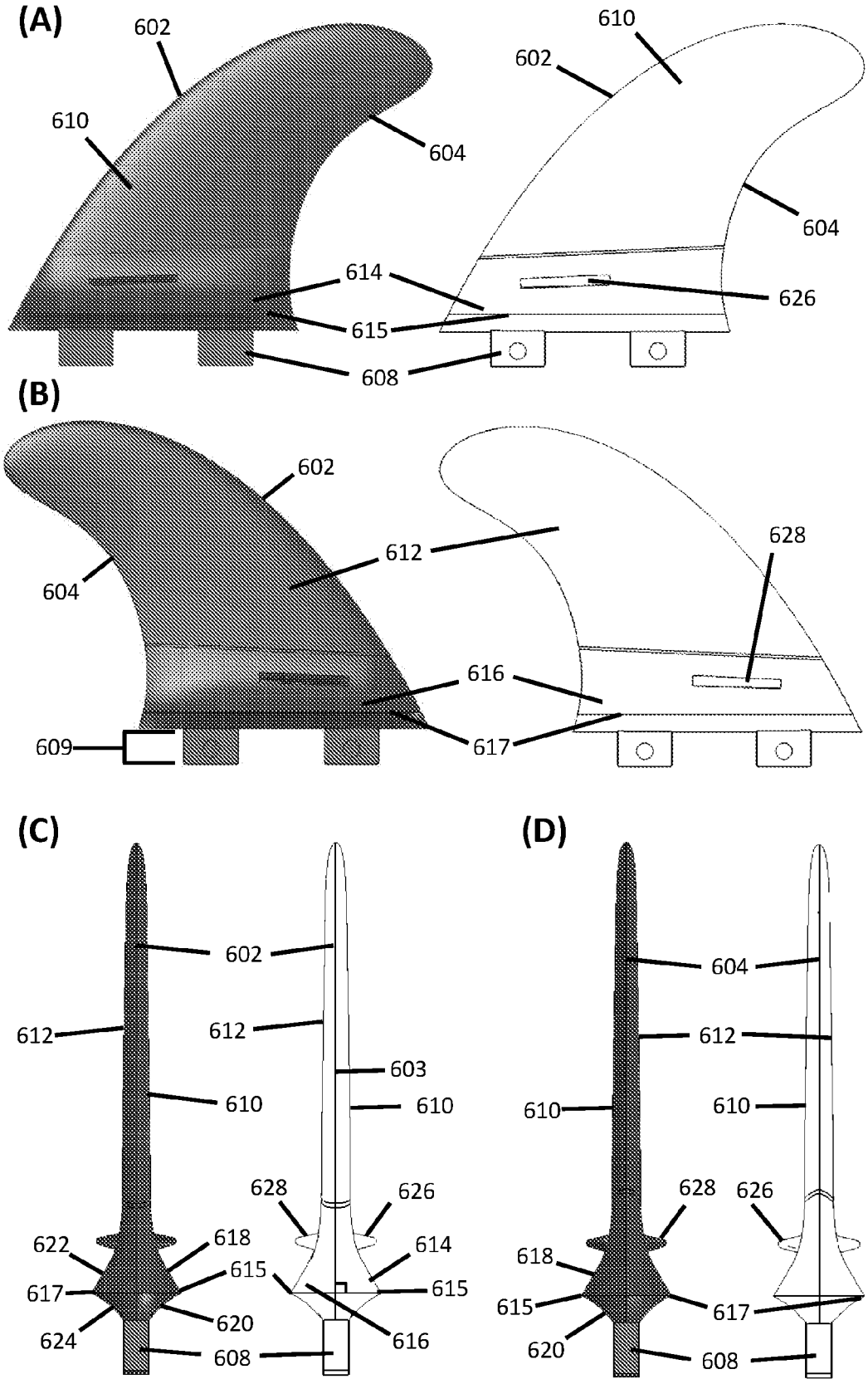
FIG. 1. matching rendered and black and white illustrations showing (A) a port (left) side view, (B) a starboard (right) side view, (C) a front view, and (D) a rear view, of a preferred embodiment of a fixed (non-adjustable) centre fin according to the invention; the fins comprising mounting blocks which can be secured within FCS® fin plugs.
Figure 2:
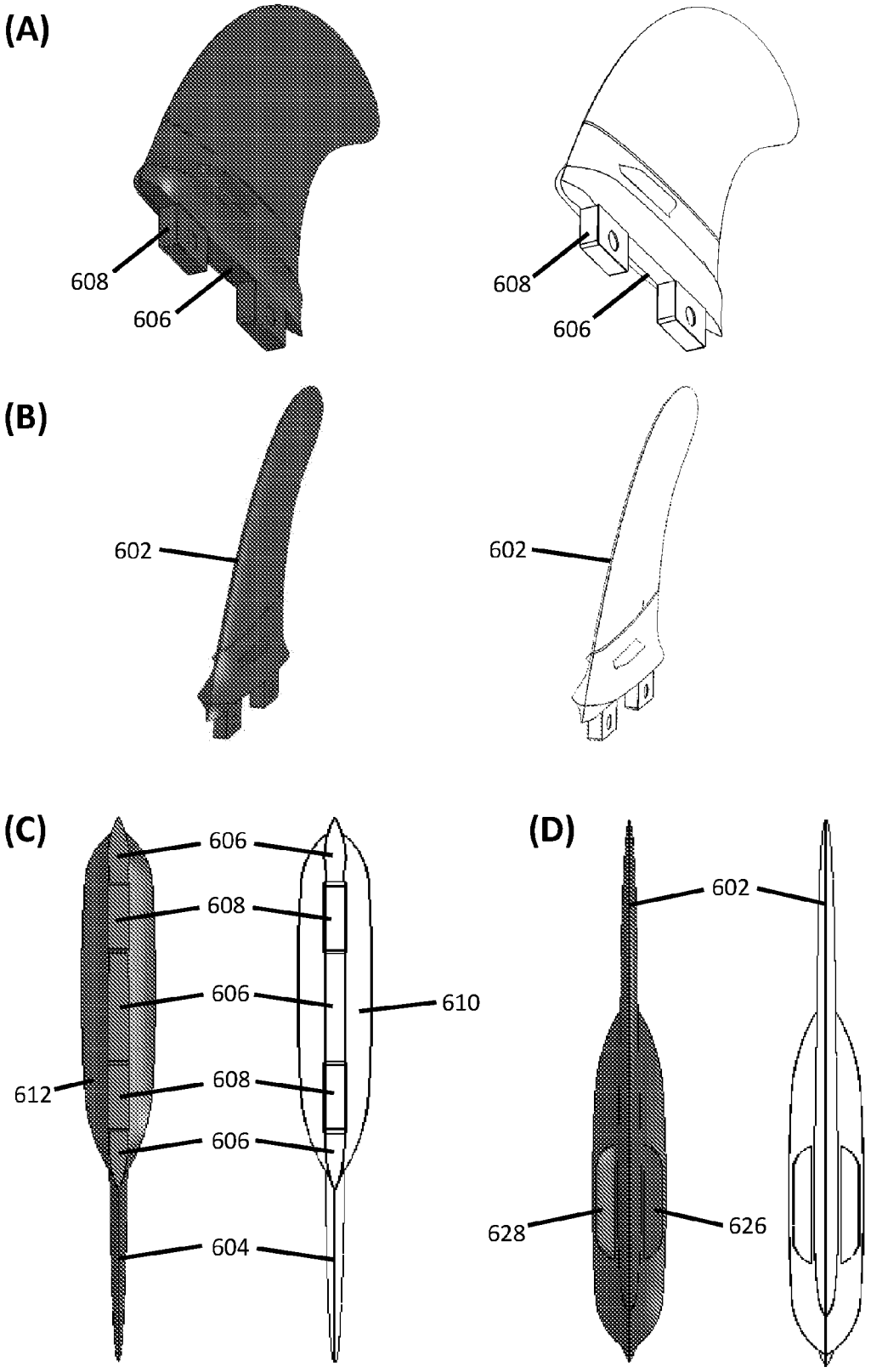
FIG. 2. matching rendered and black and white illustrations showing (A) bottom perspective view, (B) top perspective view, (C) bottom view, and (D) top view, of the preferred embodiment of the non-adjustable centre fin shown in FIG. 1.

A preferred embodiment of a fin according to the invention is shown in a variety of views in FIG. 1 and FIG. 2. The fin can be used as the centre fin of a three-fin thruster arrangement. This embodiment is a fixed, and non-adjustable form of the fin of the invention. The fin comprises a leading edge 602, a trailing edge 604, and a base 606, the base 606 comprising mounting blocks 608 which can be secured into FCS® plugs in a surfboard to mount the fin onto a surfboard. The mounting blocks 608 comprises the 'mount' 609 (or 'mounting means').

The fin further comprises a first outer fin surface on the 'port' or 'left' side of the fin (the port side outer fin surface 610), and a second outer fin surface on the 'starboard' or 'right' side of the fin (the starboard side outer fin surface 612), when considered from the rear or trailing edge 604 of the fin looking towards the front or leading edge 602. The port side outer fin surface 610 meets the starboard side outer fin surface 612 along the leading edge 602 and the trailing edge 604. Both the port side outer fin surface 610 and the starboard side outer fin surface 612 abut the base 606 by meeting along separate edges of the base 606 as shown in FIG. 2C.

Protruding laterally from the port side outer fin surface 610 adjacent the base 606 is a port side main ridge 614 (i.e. a "first ridge") from leading edge 602 to trailing edge 604. This may also be considered a port side main protrusion. Protruding laterally from the starboard side outer fin surface 612 adjacent the base 606 is a starboard side main ridge 616 (i.e. a "second ridge") from leading edge 602 to trailing edge 604. This may also be considered a starboard side main protrusion. The port side main ridge 614 and starboard side main ridge 616 lie substantially parallel to the base 606 and equidistant to the base 606. When the fin is mounted to a surfboard with mounting blocks 608 secured in FCS® plugs in the board, the port side main ridge 614 and starboard side main ridge 616 also lie substantially parallel to the bottom surface of the surfboard, at least at the location the fin is mounted.

The port side main ridge 614 and starboard side main ridge 616 produce a kite or diamond shape when viewing the front of the fin or through a cross-sectional front view. The kite or diamond shape having a truncated base at the fin base 606, and an elongated port side main ridge upper side 618 and starboard side main ridge upper side 622.

The main ridges in the fin of the invention do not comprise sections of a standard fin attached or protruding from either or both sides of the fin.

In alternative embodiment, the kite or diamond shape is instead a bulbous shape, torpedo-like shape, or tear-drop shape, with a truncated base and an elongated top, when viewing the front of the fin or through a cross-sectional front view where the ridge sides comprise convex surfaces.

In another means for describing the shape produced by the port side main ridge 614 and starboard side main ridge 616 of the fin of the invention, the front view or a cross-sectional front view shows the port side main ridge 614 and starboard side main ridge 616 protruding from the sides of the fin. The port side main ridgeline 615 and starboard side main ridgeline 617 at the crest of each ridge are at substantially right angles or at right angle planes to the centreplane 603 of the fin (shown with a symbol for a right angle superimposed over the illustration of the fin in FIG. 1C), the centreplane 603 on a plane that passes through the leading edge 602 and trailing edge 604 of the fin.

The port side main ridgeline 615 and starboard side main ridgeline 617 meet at the leading edge 602 and at the trailing edge 604.

The port side outer fin surface 610 either side of the port side main ridge 614 comprises a port side main ridge upper side 618 and a port side main ridge lower side 620.

The starboard side outer fin surface 612 either side of the starboard side main ridge 616 comprises a starboard side main ridge upper side 622 and a starboard side main ridge lower side 624.

In this embodiment, the port side main ridge lower side 620 and starboard side main ridge lower side 624 comprise a slight curve; however, they may also comprise more curvature, or less curvature, or comprise at least a portion that is flat.

In this embodiment, the port side main ridge upper side 618 and starboard side main ridge upper side 622 comprise flat and curved portions; however, they may also comprise curved portions with no flat portions, and the curved portions may have more or less curvature.

The ends of the port side main ridge 614 and starboard side main ridge 616 meet at the leading edge 602 and trailing edge 604.

A port side minor ridge 626 (i.e. a "third ridge") protrudes laterally from the port side outer fin surface 610 above the port side main ridge 614. The port side minor ridge 626 is smaller than the port side main ridge 614 and is positioned further from the base 606. The port side minor ridge 626 does not extend to the leading edge 602 or the trailing edge 604. In the embodiments of the fin that are adjustable and contain a knob, the port side minor ridge 626 can comprise the knob.

A starboard side minor ridge 628 (i.e. a "fourth ridge") protrudes laterally from the starboard side outer fin surface 612 above the starboard side main ridge 616. The starboard side minor ridge 628 is smaller than the starboard side main ridge 616 and is positioned further from the base 606. The starboard side minor ridge 628 does not extend to the leading edge 602 or the trailing edge 604 though may in other embodiments. In the embodiments of the fin that are adjustable and contain a knob, the starboard side minor ridge 628 can comprise the knob.

The port side minor ridge 626 and starboard side minor ridge 628 may be parallel to the main ridges, but in this embodiment, the port side minor ridge 626 and starboard side minor ridge 628 have a slight angle of attack towards the base at the ends closest the leading edge 602 as shown in FIGS. 1A and 1B. The port side minor ridge 626 and starboard side minor ridge 628 may also be tapered in shape towards their ends or evenly shaped throughout their length. The ends of the port side minor ridge 626 and starboard side minor ridge 628 may be rounded as shown or end in a relatively sharp point, or even squared ends, for example, at the rear end of the minor ridges. Alternatively, the minor ridges may be the shape of inverted flat foils with the flat surface of the foil facing the direction of the base 606.

In another preferred embodiment, the fin according to the invention may not comprise one or more port side minor ridge and/or starboard side minor ridge. Alternatively, the fin according to the invention may comprise additional minor or major ridges on one or both sides of the fin, similar or different to the ridges shown in these preferred embodiments.

This embodiment of the non-adjustable fin is made in a mould constructed in one part, though could be constructed from more than one part.

Figure 3:
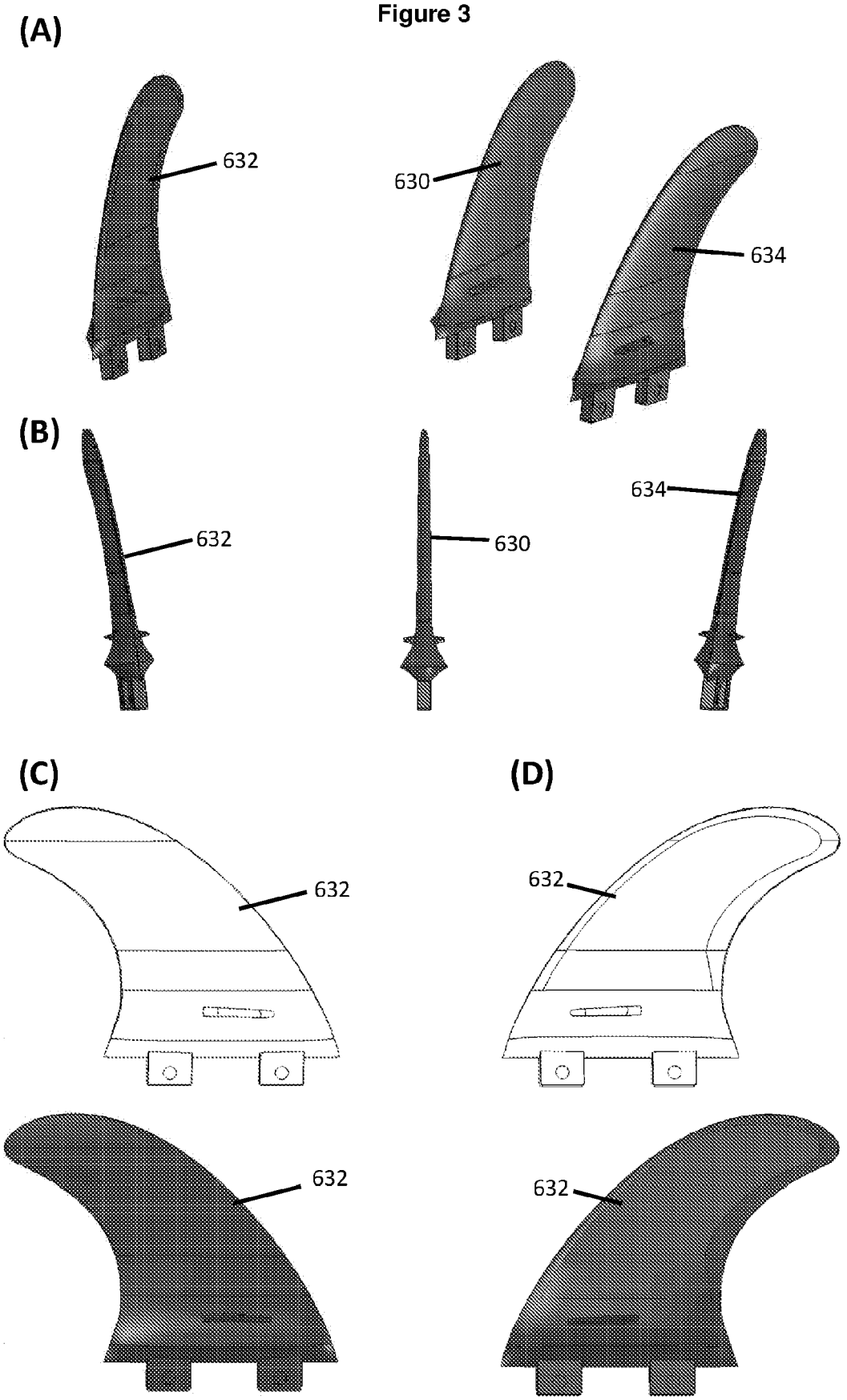
FIG. 3. rendered illustrations showing (A) a perspective view, and (B) a front view, of a preferred embodiment of a three-fin thruster arrangement of non-adjustable fins according to the invention; and matching rendered and black and white illustrations showing (C) a starboard side view, and (D) a port side view of the starboard side fin of the thruster arrangement of (A) and (B), the fins comprising mounting blocks which can be secured within FCS® fin plugs.

FIG. 3 shows in 3A and 3B a three fin 'thruster' arrangement similar to how the fins would be positioned once mounted to a surfboard. The centre fin 630 is set back from the side fins, and the side fins positioned with a slight inwards toe towards the centre of the arrangement and on a slight outward cant. The right or 'starboard' fin 632 of the thruster arrangement and left or 'port' fin 634 of the arrangement may be identical to the centre fin 630 or may comprise differences. FIG. 3C shows the right side of the starboard fin 632, and FIG. 3D shows the left side of the starboard fin 632.

Figure 4:
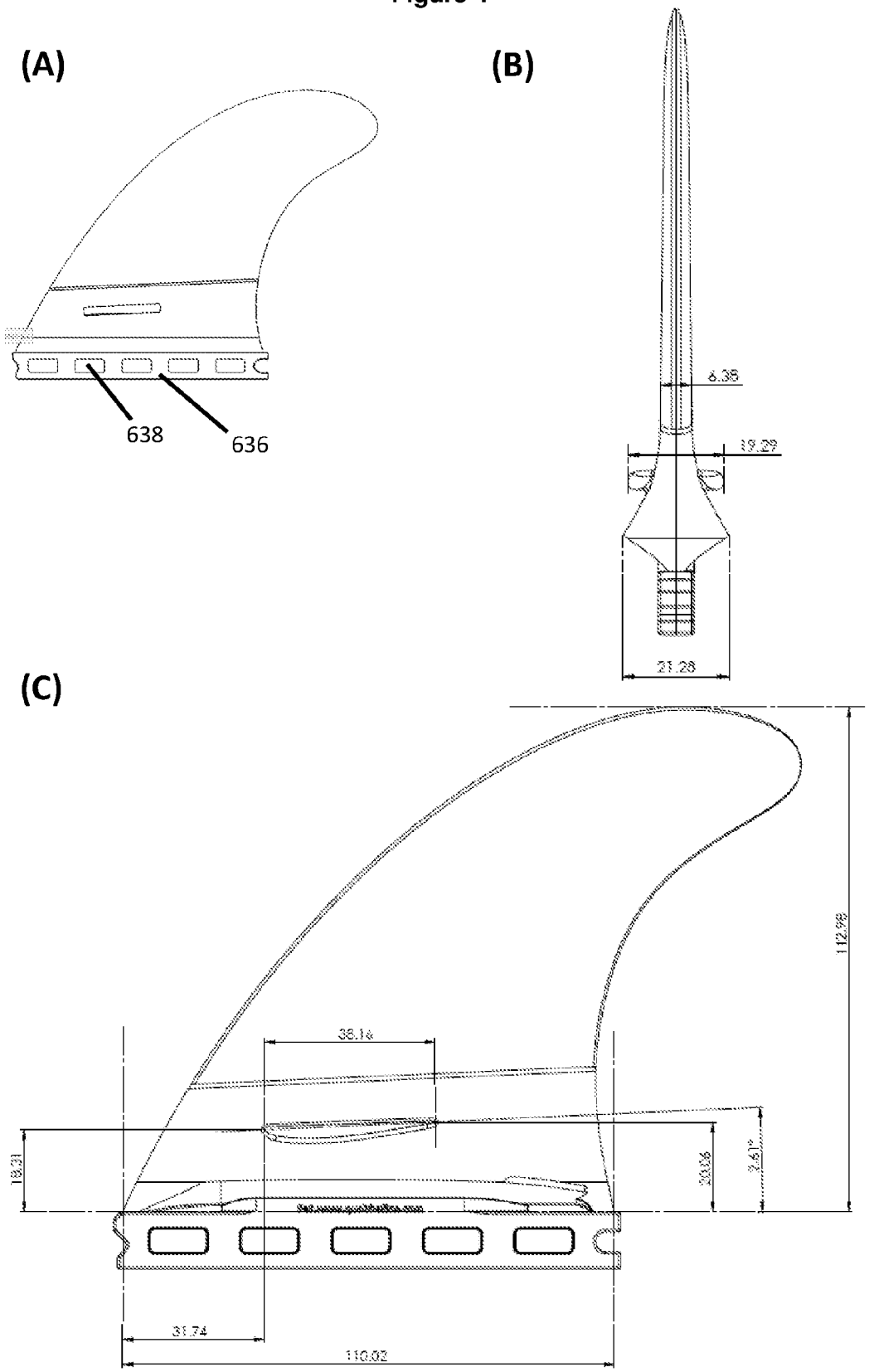
FIG. 4. illustrations of (A) a side view, (B) a front view, and (C) a side view, of preferred embodiments of a non-adjustable centre fin according to the invention with a mounting block which can be secured within a Futures® fin box.

FIG. 4 shows a fin according to the same embodiment except the mount at the base comprises a single mounting block 636 which can mount the fin into a Futures® finbox in a surfboard. FIG. 4A shows a mounting block 636 with one shape of mounting block holes 638. However, other mounting block hole shapes or cutouts, including triangles, ovals, or circles, amongst others, are also within the scope of the invention. Alternatively, there may be no cutouts, or holes in the mounting block 636 though the benefit of such holes is to reduce weight and the amount of material required to manufacture the fin which can be a cost saving.

FIGS. 4B and 4C show a front and side view, respectively, of a further embodiment of the fin with dimensions in mm shown. As is shown from the dimensions in FIG. 4B of the front view of the fin according to a preferred embodiment of the invention, the thickness of the fin between the first main ridgeline and second main ridgeline (i.e. at its widest point of the major ridges) is 21.28 mm. The thickness of the fin between first outer fin surface and second outer fin surface above the main ridges and ridge sides at its widest point is 6.38 mm. Thus, the maximum width of the main ridges when compared to the maximum thickness of the (non-ridged portion of the) fin above the ridges equals a factor of approximately 3.33 (i.e. 21.28/6.38=3.33). The factor would be approximately the same if there was only a main ridge on one side, for example, for a flat foil version of the fin according to the invention.

The distance between the main ridgeline and base (where the fin meets the mount) is approximately 7 mm. Thus, the distance of the main ridgeline to the base is approximately 6% of the distance of the base to the tip of the fin.

The maximum thickness of the minor ridges at 19.29 mm, when compared to the maximum thickness of the (non-ridged portion of the) fin at 6.38 mm, equals a factor of approximately 3 (i.e. 19.29/6.38=3.33). The distance between the minor ridge and base (where the fin meets the mount) is approximately 18.31 mm. Thus, the distance of the minor ridge to the base is approximately 16% of the distance of the base to the tip of the fin.

The distance between the front of the fin where the leading edge meets the base and mount, and the front end of the minor ridge is 31.74 mm. Thus, the minor ridge starts approximately one third of the distance of the total fin behind the front of the fin. The distance between the rear of the fin where the trailing edge meets the base and mount, and the rear end of the minor ridge is 40.12 mm. Thus, the minor ridge ends approximately one third (approximately 36%) of the distance of the total fin from the end of the fin.

The shape of the minor ridge is of FIG. 4C is substantially a flat foil with a flat upper surface facing away from the base. The maximum height of the minor ridge is approximately 5 mm. The 'angle of attack' of the minor ridge towards the base is 2.61°.

The distance from the base to where the upper ridge sides merge into, meet, or become, the outer fin surface is approximately 30 mm. Thus, the portion of the height of the outer fin surfaces of the fin comprising ridges is approximately one quarter (approximately 26.5%) of the height of the fin from base to tip.

Figure 5:
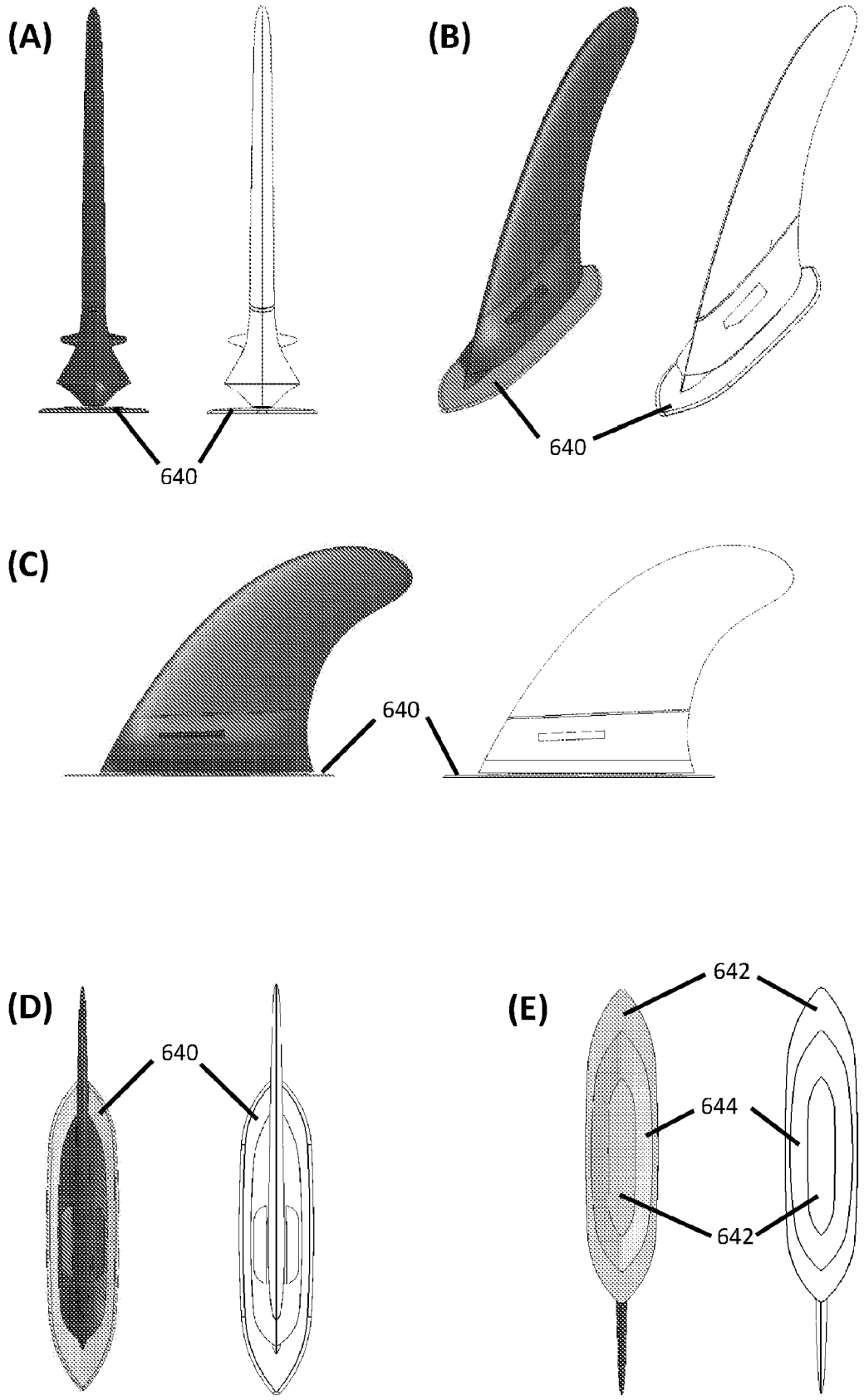
FIG. 5. matching rendered and black and white illustrations showing (A) front view, (B) top perspective view, (C) port side view, (D) top view, and (E) bottom view, of a preferred embodiment of a non-adjustable centre fin according to the invention with a base attachment surface for mounting the fin to the bottom surface of a surfboard.

FIG. 5 shows a fin according to the same embodiment except the mount at the base comprises a base attachment plate 640 as a further means for mounting the fin to a surfboard, as already described herein. The base attachment plate comprises a substantially flat base attachment surface 642 for contacting to the external bottom surface of a surfboard to which it is to be mounted (FIG. 5E). Cavities 644 (which could also be referred to as indents) which are oval-shaped in this embodiment but may comprise a variety of different shapes, are locations for adhesive which will be one means by which the fin can be attached to the external bottom surface of a surfboard. Preferably, the adhesive is injected into each cavity 644 through an injection conduit in the form of a tunnel or injection hole through the base attachment plate 640 (not shown) once the base attachment plate 640 is placed in the desired position on the surfboard to which it is to be mounted. A second injection conduit (not shown) in each cavity 644 would enable air to be released from the cavity 644 as the adhesive is injected into a first injection conduit and spreads throughout the cavity 644. Thus, the formation of air bubbles and therefore weaknesses in the adhesive attachment can be avoided. Once the cavity 644 is full of adhesive, excess adhesive will exit the second injection conduit indicating that the cavity 644 is full, and the excess adhesive can be wiped away before it dries. Preferably, screws are driven through injection conduits and into the surfboard prior to, or after the adhesive has dried, to provide additional strength in the attachment of fin to the surfboard to which it is mounted.

The portion of the fin relative to the base attachment surface 642 may be created at a specific cant for use as side fins in a thruster set up.

Figure 6:
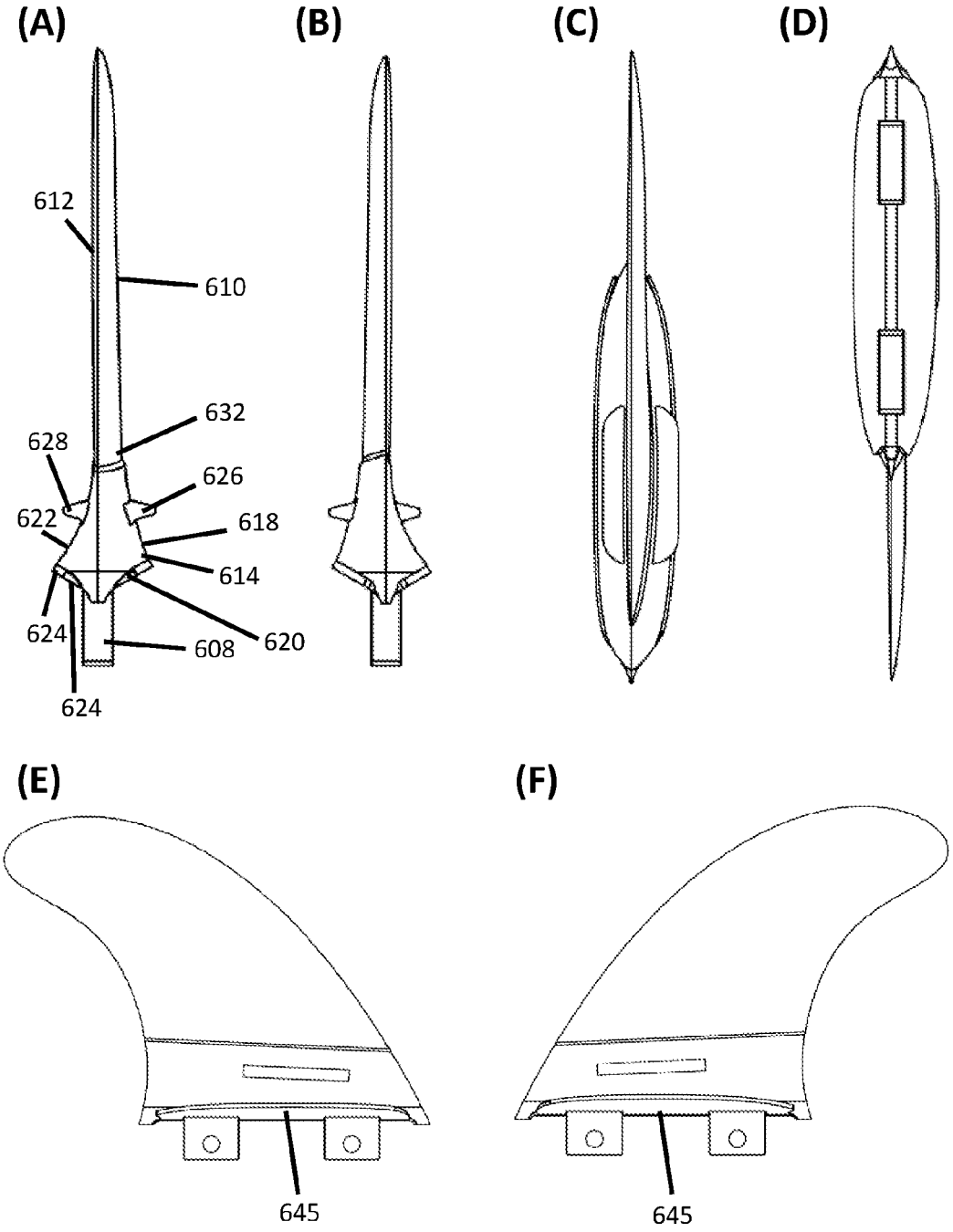
FIG. 6. illustrations showing a (A) front view, (B) a rear view, (C) top view, (D) bottom view, (E) starboard side view, and (F) port side view, of a non-adjustable port side fin (left side fin) according of the invention for use in a dual, thruster or quad arrangement, with mounting blocks that can be secured within FCS® fin plugs.

FIG. 6 shows a left or port side fin 634 as shown in the thruster arrangement of FIG. 3 with mounting blocks which can be secured into FCS® plugs in a surfboard in the port side position of a thruster or quad arrangement. Front the front view, the port side fin 634 is asymmetric as opposed to the centre fin of FIG. 1 and FIG. 2. This asymmetric configuration aims to benefit from both: (i) the effect of having both the main ridges and minor ridges on both sides of the fin to reduce the size of trailing vortices to reduce drag; and (ii) a substantially flat portion on the starboard side outer fin surface 612 of the port side fin 634 (that is, facing towards the centre line or stringer of the surfboard) and a curved port side outer fin surface, which can generate the known thrust experienced with flat foil side fins in a thruster arrangement on a surfboard as already described herein.

FIG. 6 shows the port side minor ridge 626 and starboard side minor ridge 628 are of a similar size and equidistant to the base. However, the starboard side main ridge 616 and starboard side main ridge upper side 622 and starboard side main ridge lower side 624 are all smaller than the port side main ridge 614 and port side main ridge upper side 618 and port side main ridge lower side 620, respectively. The starboard side main ridge upper side 622 merges into the substantially flat starboard outer fin surface 612.

Support plates 645 have been attached in this embodiment to the port side main ridge lower side 620 and starboard side main ridge lower side 624 to provide additional strength to this portion of the fin. Such support plates 645 may, or may not be part of the fins of the invention. Support plates 645 may be a metal or metal alloy including those already described herein. In a preferred embodiment, the support plates are made from titanium alloy.

Gaps are produced between the support plate 645 and the surfboard onto which the fin in this embodiment is mounted, between the mounting blocks 608 and the front and rear of the fin where the leading edge 602 and the trailing edge 604 meet the bottom surface of the surfboard. These gaps assist to provide additional beneficial effects on the vortices created as water passes the fin according to the invention during use on a wave as shown in the modelling and analysis below.

In this respect, the fin according to the invention can comprise one or more gaps between the base of the fin and the surfboard onto which it is mounted. These gaps may vary in shape, size, and height between surfboard and base, according to the desired vortices to be created around the fin as water passes the fin according to the invention.

Without wanting to be limited by any one theory, a benefit of elevating a fin section from the outer surface of a surfboard on which it is mounted is to allow creation of additional vortices, when compared to a fin section which abuts or aligns flush with the outer surface of a surfboard.

A starboard side fin (not shown in FIG. 6) will be the mirror image of the fin shown in FIG. 6.

Figure 7:
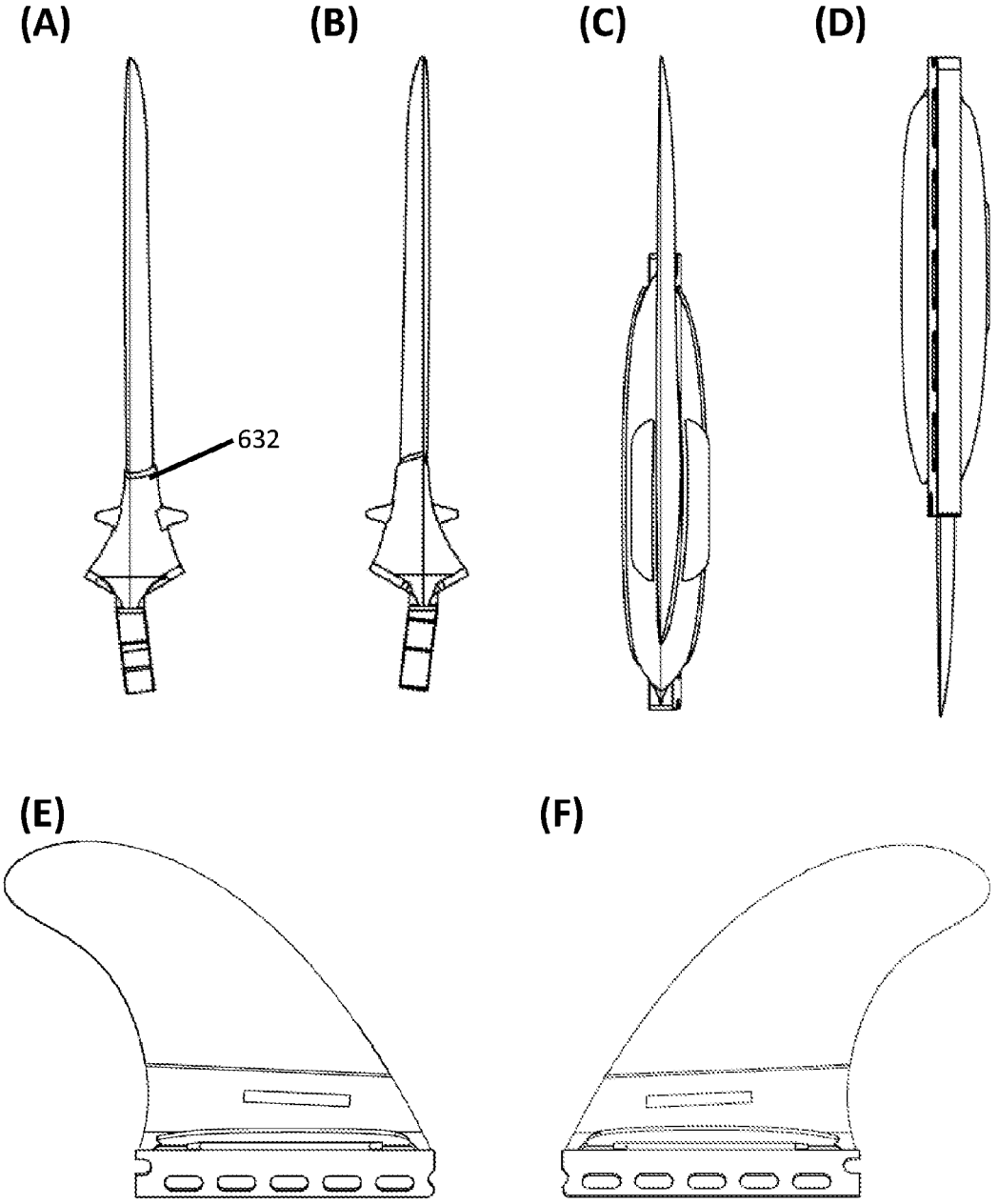
FIG. 7. illustrations showing a (A) front view, (B) a rear view, (C) top view, (D) bottom view, (E) right or starboard side view, and (F) left or port side view, of a non-adjustable port side fin according to the invention for use in a dual, thruster or quad arrangement, with a mounting block that can be secured within a Futures® fin box.

FIG. 7 is the same as the port side fin of FIG. 6 but with a mounting block which can be secured into a Futures® fin box in a surfboard in the port side position of a thruster or quad arrangement. A starboard side fin (not shown in FIG. 7) will be the mirror image of the fin shown in FIG. 7.

Figure 8:
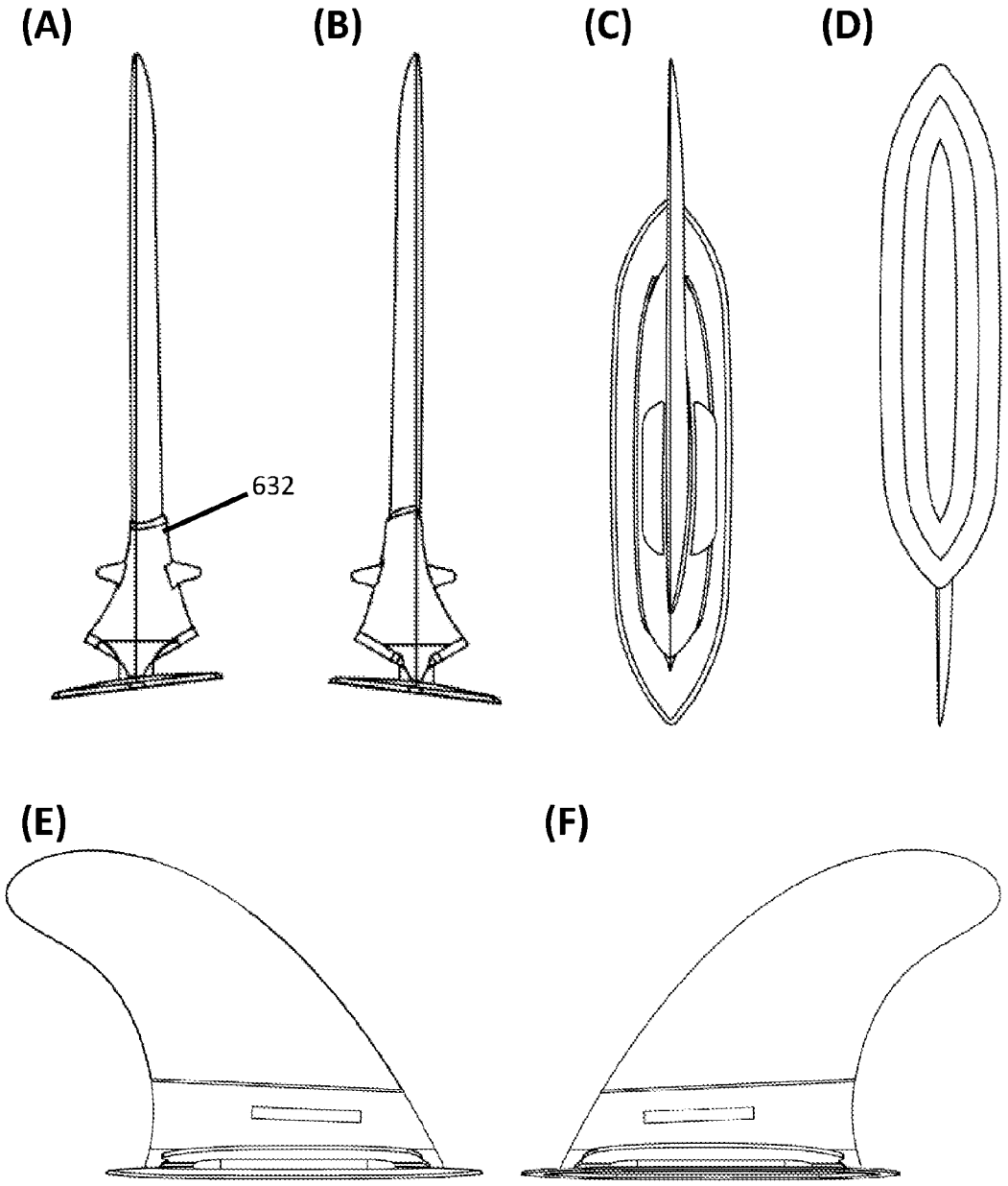
FIG. 8. illustrations showing a (A) front view, (B) a rear view, (C) top view, (D) bottom view, (E) right or starboard side view, and (F) left or port side view, of a non-adjustable port side fin according to the invention for use in a dual, thruster or quad arrangement, with mounting blocks that can be secured with a base attachment surface for mounting the fin to the bottom surface of a surfboard.

FIG. 8 is the same as the port side fin of FIG. 6 but with a base attachment surface for mounting the fin to a surfboard as described herein in the port side position of a thruster or quad arrangement. A starboard side fin (not shown in FIG. 8) will be the mirror image of the fin shown in FIG. 8.

Initially, the inventor introduced the main ridges either side of the fin of the invention to increase the width of the fin to accommodate an internal mechanism for adjusting a fin section relative to a base. The minor ridge was formed to accommodate the locking mechanism in order to reduce drag created by the protruding locking knob. However, during testing of the fins by expert surfers, surfing waves on surfboards to which fins according to these embodiments of the invention were mounted, additional velocity was experienced by the surfers on waves, particularly during turns, when compared to standard flat fins. Upon further analysis, it was considered that the shape of the fins was causing the increase of speed due to reduction of drag forces. This was predicted to be taking place through affecting vortices adjacent where the fin is mounted onto the board. It is understood that where large vortices are created behind an object moving through water, or air, these large vortices create drag or a 'sucking' effect, therein reducing velocity. Disruption of the formation of large vortices by instead creating smaller vortices around the base of the fin either sides of the main ridges, resulting in a reduction of drag forces behind the fins was predicted to be causing the observed effect. Thus, computational fluid dynamics modelling and analysis was performed to confirm the benefits provided by these fin configurations when compared to standard flat fins.

Computational Fluid Dynamics Modelling and Analysis Background

Figure 9:
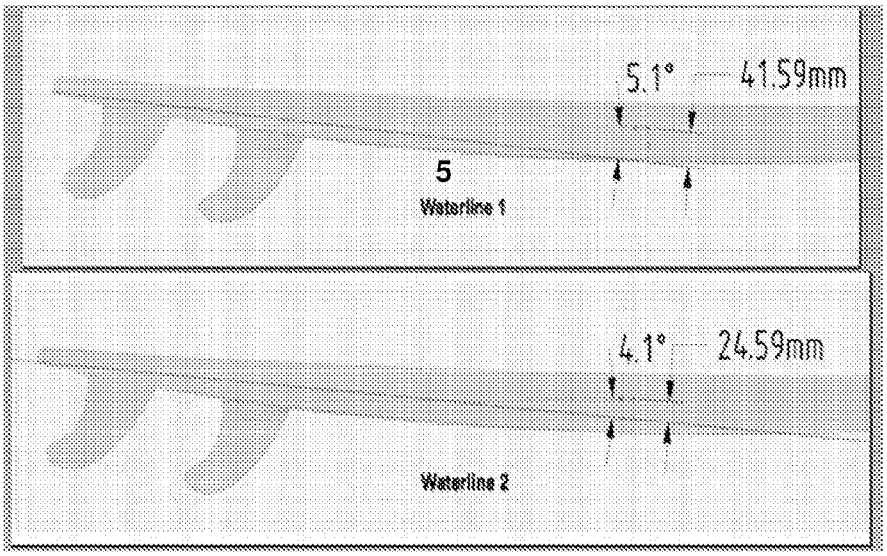
FIG. 9. (A) Graphical representation of a sectional component of a conventional modern surfboard coupled with either the Inventive fins (fins according to the invention) or Standard fins, and showing the two geometries modelled; illustrations of: (B) the simulation domains at the Waterline 1 for the fins modelled, and (C) a front view of the geometry with inlet flow moving into the paper (as denoted by crosses).
Figure 9:
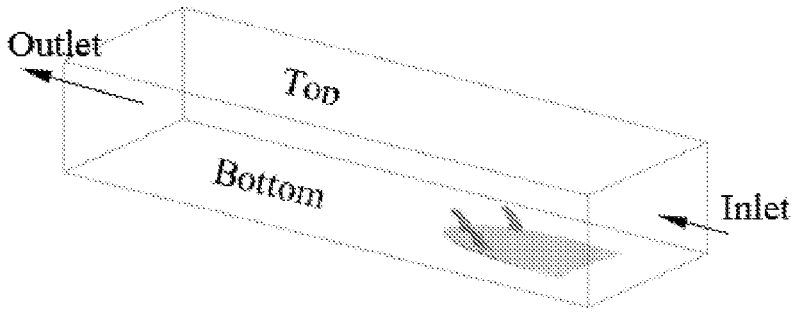
Figure 9:
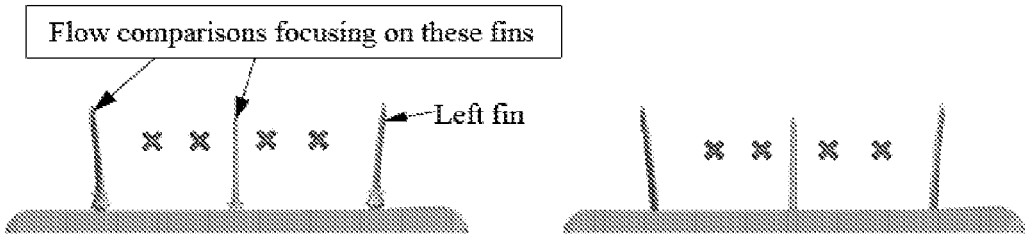

Comparative computational fluid dynamics (CFD) modelling of a three-fin 'thruster' arrangement of: fins of the invention (the "Inventive fins" or "INV"), compared to standard, commercially available flat fins (the "Standard fins" or "STD") as shown in FIG. 9, was conducted by Aurora Offshore Engineering (Aurora). The modelling software used was the widely documented, validated and accepted open-source numerical modelling tool OpenFOAM®, which is a general-purpose CFD modelling code for solving the Reynolds Averaged Navier-Stokes equations for fluid flow.

The geometries modelled are shown graphically in FIG. 9A featuring a sectional component of a conventional modern shortboard surfboard coupled with either the inventive fins or Standard fins. Two waterlines have been considered as shown in the FIG. 9A. The flow velocity combinations are given in Table 1. The flow direction is always parallel to the waterlines as given in FIG. 9A.

TABLE 1

Flow velocity combinations modelled.

| | INV Fins | STD Fins |
|---|---|---|
| Waterline 1 | 10 m/s | 10 m/s |
| Waterline 2 | 7 m/s | 7 m/s |
| | 4 m/s | 4 m/s |

Figure 10:
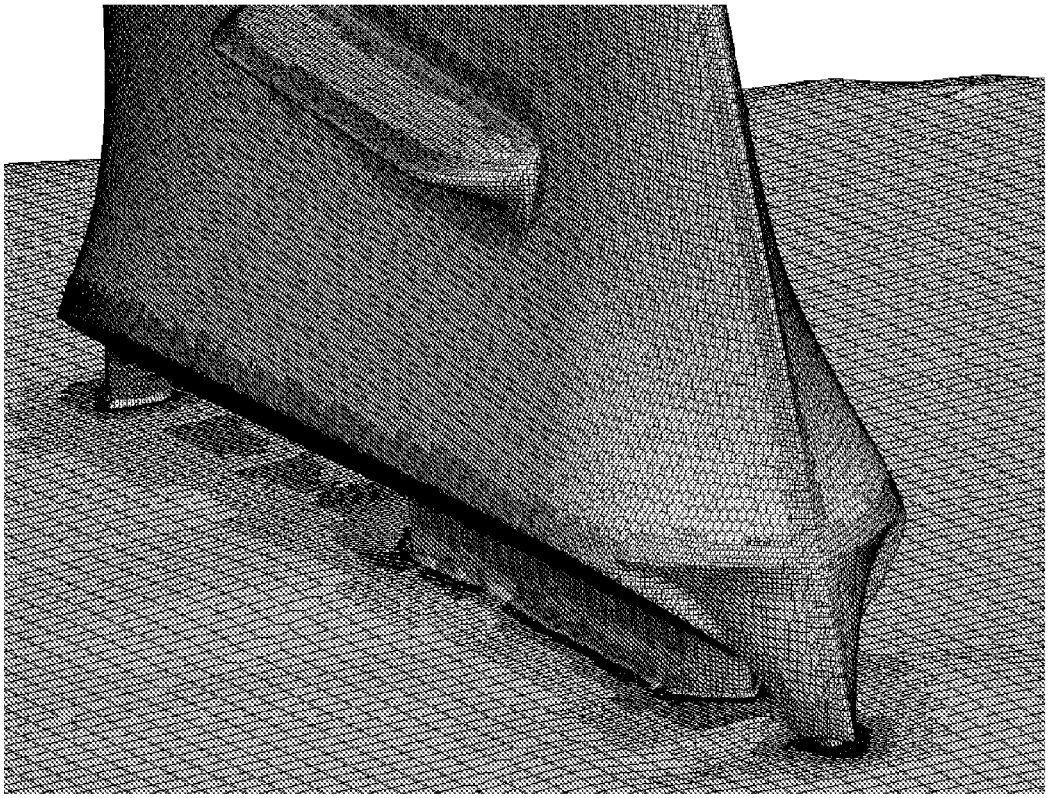
FIG. 10. Graphical representation of a mesh distribution on the rear Inventive fin (157 million faces, such as those appeared on the fin, are used in the simulation at Waterlevel 1). The overall mesh cell thickness on the board is 0.4 mm and on the fin is 0.06 mm, leading to y+ in the range of 30~100-300 to allow wall function to be used.

The numerical model of the fluid flow was constructed using a rectangular domain containing the relevant board and fin sections as shown in FIG. 9B. The position and orientation of each fin system is shown in FIG. 9C and a view of the surface mesh on the base of the board, the main ridge (comprising the first and second ridges), and the minor ridge (comprising the third and fourth ridges) shown in FIG. 10.

Results

Figure 11:
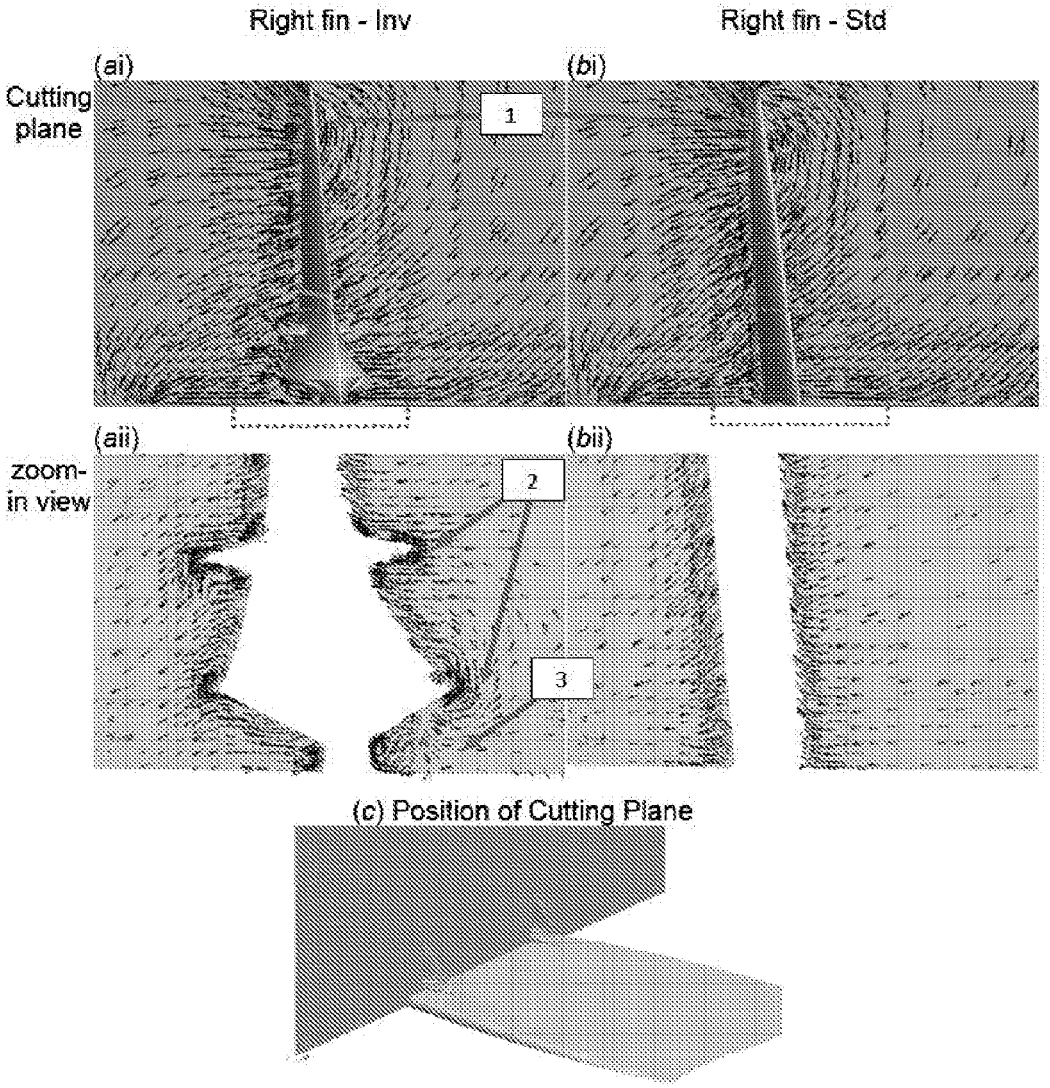
FIG. 11. Secondary velocity vectors (Ux, Uz) comparison between right (a) Inventive fins and (b) Standard fins (at 10 m/s). (c) shows the position of the cutting plane through the lateral fins.

The analysis of the results focuses on investigation and identification of the flow fields around the different fin systems and differentiation of their resulting performance. FIG. 11 gives the velocity vector field normal to the board velocity and located on a cut-plane down through the side fins as shown in FIG. 11*c*. The secondary velocity field as generated by (Ux, Uz) shown in this figure demonstrates how the influences of the Inventive fin features on the local flow field compared to the Standard fins, showing (1) that both fins generate a similar trailing wake vortex around the fin tip, while (2) the Inventive fin main ridge and minor ridge also generate division of the longitudinal flow near the base of the fin. These rotational flows appear to be more apparent at the locations of geometry change along the Inventive fin, as shown in (3).

Figure 12:
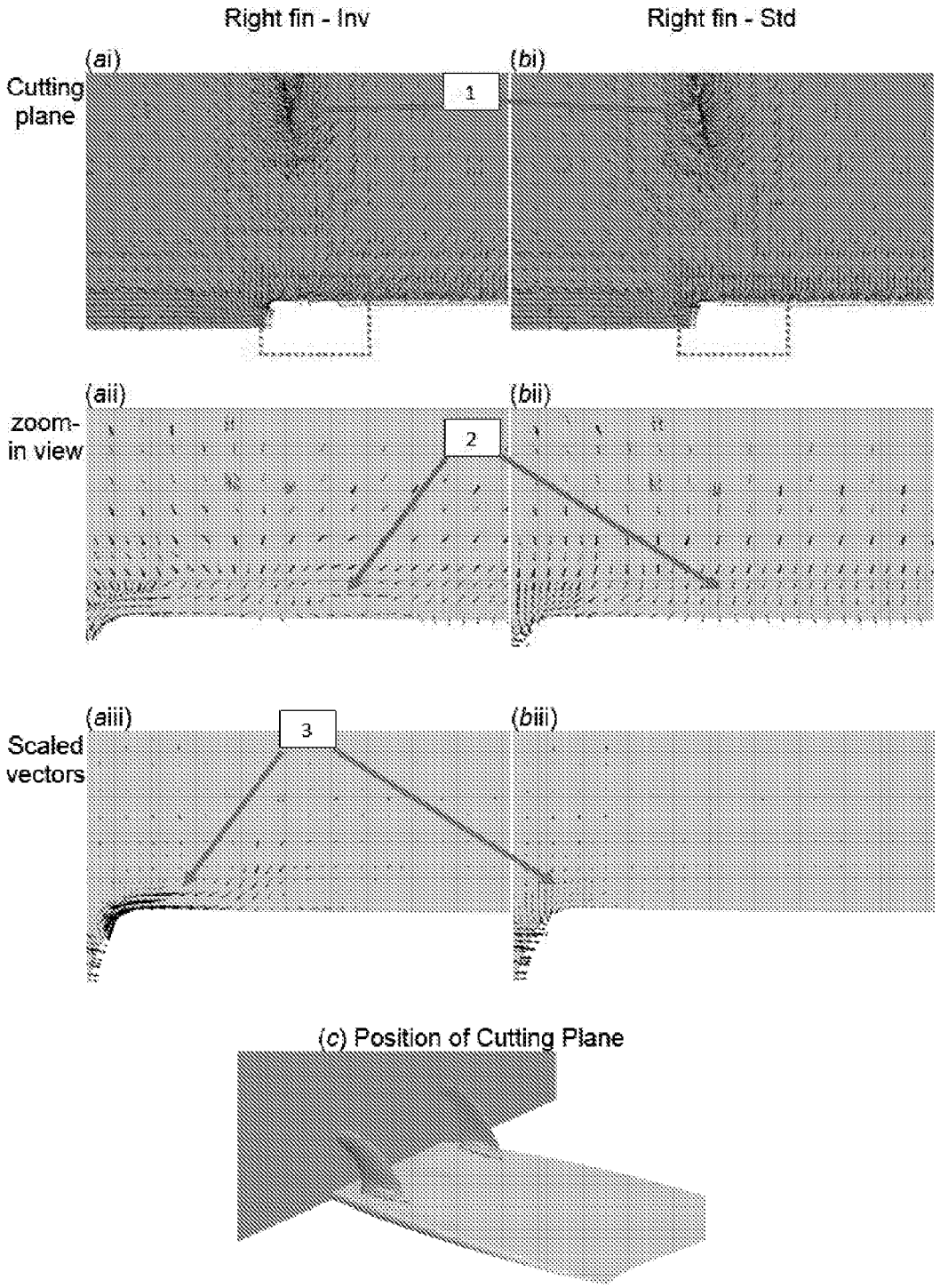
FIG. 12. Secondary velocity vectors (Ux, Uz) comparison between right (a) Inventive fins and (b) Standard fins (at 10 m/s). (c) shows the position of the cutting plane aft of the lateral fins.

FIG. 12 gives the velocity vector field normal to the board velocity and located on a cut-plane down just aft of the side fins as shown in FIG. 12*c*. The secondary velocity field as generated by (Ux, Uz) shown in this figure demonstrates how the influences of the Inventive fin features on the local flow field compare to the Standard fins, showing (1) that both fins generate a trailing wake vortex around the fin tip, while (2) the Inventive fin main ridge and minor ridge also generate a significant change in the flow behaviour against the board surface adjacent to and inboard of the fin. Comparing the flow at (3) in FIG. 12(*iii*), the Inventive fins cause changes in not only the direction of the flow, but also in the magnitude of the velocity.

Figure 13:
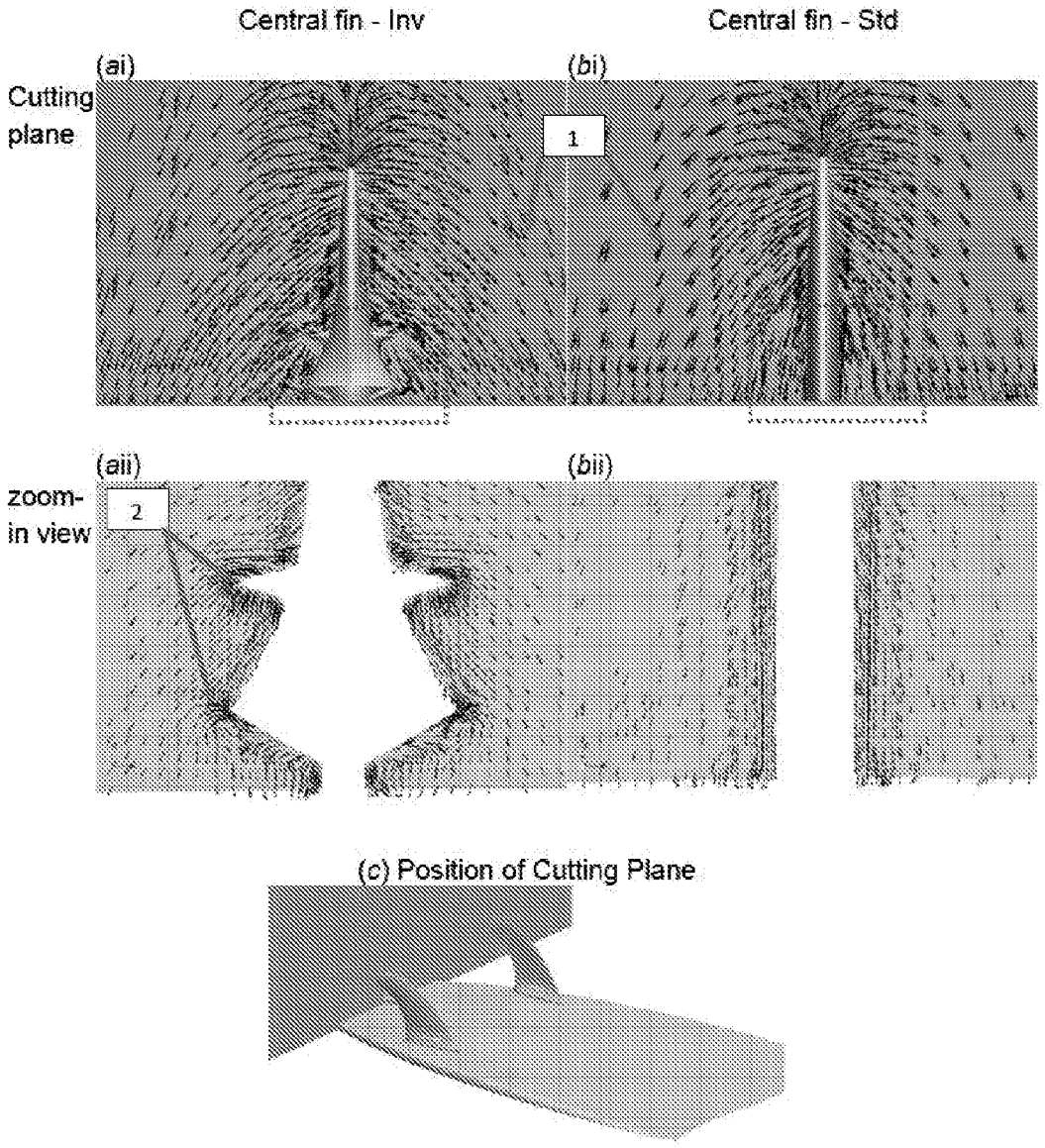
FIG. 13. Secondary velocity vectors (Ux, Uz) comparison between central Inventive fins and Standard fins (at 10 m/s). (c) shows the position of the cutting plane through the aft central fin.

The effect of flow past the rear central fin is shown in FIG. 13 which gives the velocity vector field normal to the board velocity and located on a cut-plane through the aft fin as shown in FIG. 13*c*. The secondary velocity field as generated by (Ux, Uz) shown in this figure demonstrates how the influences of the Inventive fin features on the local flow field compare to the Standard fins, showing (1) that the prevailing flow at this location is upwards towards the free water surface and board, while (2) the Inventive fin main ridge and minor ridge also generate division of the longitudinal flow near the base of the fin, which are similar to those features in FIG. 11.

Figure 14:
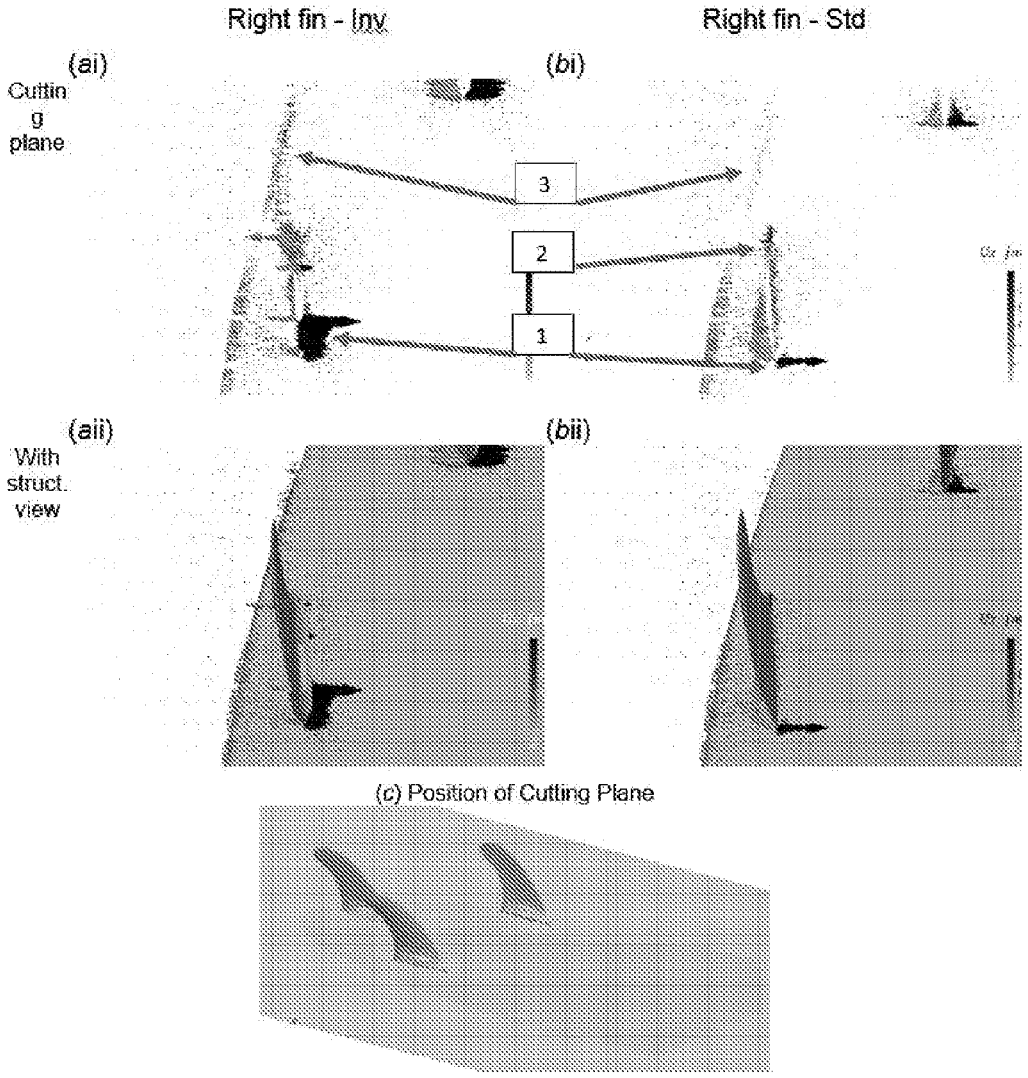
FIG. 14. Flow field comparison showing lateral velocity Ux [m/s] on a cut-plane located at the gap height under the lateral Inventive fin immediately adjacent to the board surface.

Differentiation of the flow behaviour between the inventive and Standard fins is also investigated by considering a cut-plane parallel to and slightly below the board surface as shown in FIG. 14*c* at the elevation of the gap between the Inventive main ridge and the board. As can be seen by comparison of the lateral velocity (Ux) between figures (a) and (b), the flow immediately adjacent to the board differs significantly between the Inventive and Standard fins, with (1) the Inventive fin frontal gap under the main ridge enabling significant inboard flow, followed by (2) the rear gap enabling significant outboard flow which is not possible with the Standard fin which has continuous contact with the board surface. The downstream wake behind the fins (3) shows significant continuation of the wake from the Inventive fin which is much stronger than for the Standard fin.

Figure 15:
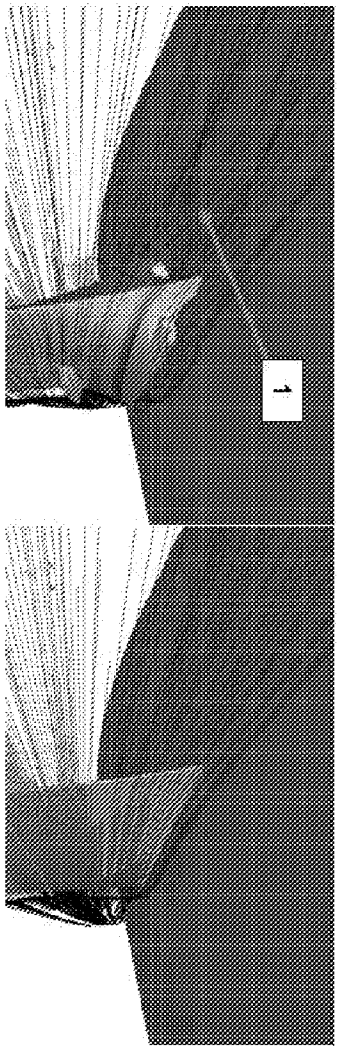
FIG. 15. Streamlines generated besides the Inventive fins and Standard fins (at 10 m/s) showing the formation of a longitudinal wake vortex behind the 'lower ridge'.

To further assist in understanding the response of the flow to the presence of the key design elements of the Inventive fin, streamlines are generated down either side of each fin system as illustrated in FIG. 15, looking forwards from behind the lateral fin. The streamlines demonstrate the formation (1) of a persistent downstream longitudinal wake vortex with its axis of vorticity centred around the longitudinal axis of the main ridge (which is predicted by the inventor to act in a manner similar to a caudal keel of some fast fish). This wake vortex is located adjacent to the board surface and is therefore anticipated to have a significant influence on the flow past the board downstream of the Forces in Tables The hydrodynamic forces extracted from the CFD model for each of the fins are presented in Table 2.

TABLE 2

Figure 16:
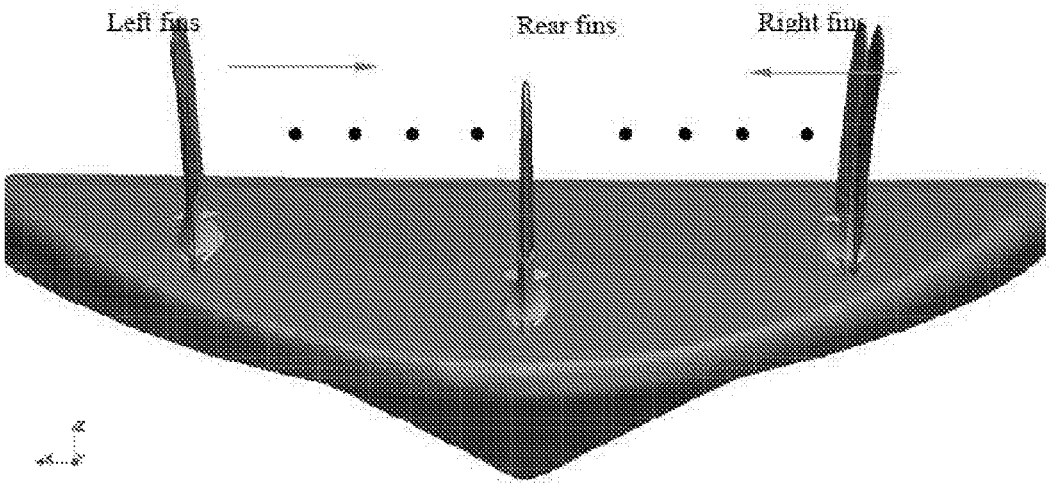
FIG. 16. The comparison on the geometry of Inventive fin (inner side fins) and the Standard fin (outer side fins), with inlet flow moving out the paper (as denoted by dots), where 'right' fin is the starboard fin and 'left' fin is the port fin in the thruster arrangement.

The ratios of change in lateral forces of inventive fins compared to Standard fins. Note: The sign convention is that the forces are the water force on the fin, which is oriented so that (for 4 and 7 m/s) the forces are towards the inner side of the board as shown in Figure 16.

| Board Speed | Waterline | | Lateral Force on Fin f(x) [N] | | |
|---|---|---|---|---|---|
| [m/s] | (Figure 9A) | Fin | INV | STD | Δf(x) |
| 4 | 2 | Port | −2.71 | −3.98 | −32% |
| | | Centre | 0.09 | 0.18 | −50% |
| | | Starboard | 2.63 | 4.55 | −42% |
| 7 | 2 | Port | −17.86 | −12.03 | 48% |
| | | Centre | 0.24 | 0.52 | −54% |
| | | Starboard | 17.87 | 13.72 | 30% |
| 10 | 1 | Port | −11.84 | 6.72 | −276% |
| | | Centre | −0.54 | 1.65 | −133% |
| | | Starboard | 13.27 | −3.76 | −453% |

The key observations from this are that:

- The lateral fin forces are considered as giving the best indication of how much of an effect the fins are having on the flow over the board;
- The centre fins have very low forces and therefore are expected to have very little effect since they are aligned with the flow;
- The lateral fins (both types and at all speeds) produce roughly equal and opposite forces—this is expected since the board is travelling straight ahead. There are subtle differences in the geometries which can be seen in the differences between left and right forces; and
- The lateral forces increase as speed increases for waterline 2, but the change in waterline and velocity results in a change in the direction of the forces on the Standard fins.

In general, lateral forces increase greatly on the Inventive fins, compared to the Standard fins, which is anticipated to be important in the observed speed increase with Inventive fins. It will also be very important in the performance and stability of the board during turning manoeuvres, one of the most frequent actions needed to be taken during surfing.

Conclusions

The results of the CFD modelling show a significant change in the flow of water immediately adjacent to the board and downstream of the fins of the invention when compared to the standard fins in a thruster arrangement. These flow changes are potential causes for the observed speed and stability increases observed for boards using the fins of the invention.

Prior to the modelling, the additional thrust was predicted to be due to the disruption of the formation of large vortices by instead creating smaller vortices around the base of the fin either sides of the main ridges, resulting in a reduction of drag forces behind the fins. However, the results of the modelling showed that while part of the additional forward thrust experienced was due to the effect of disruption or reduction of trailing vortices which reduced the negative 'sucking' effects (but maintained the area of high pressure), the main effect was that the ridges created a vortex as a result of the combination of the surfaces of (i) the lower surface of the surfboard adjacent to the fin, (ii) the lower main ridge surface adjacent the board, and (iii) the minor ridge. This vortex created a measurable area of lower pressure surrounding the lower portion of the fin and in front of the fin when compared to surrounding water and the high pressure measured behind the fin. Incredibly, an area of low pressure created in front of the fin was shown (video not able to be included) to be up to 500 mm long beneath the surfboard. This effect is believed to be the cause of the additional thrust (towards the area of lower pressure) experienced by surfers using fins according to the invention when compared to standard fins without the major or minor ridges.

Detachable and Adjustable Fin

Figure 17:
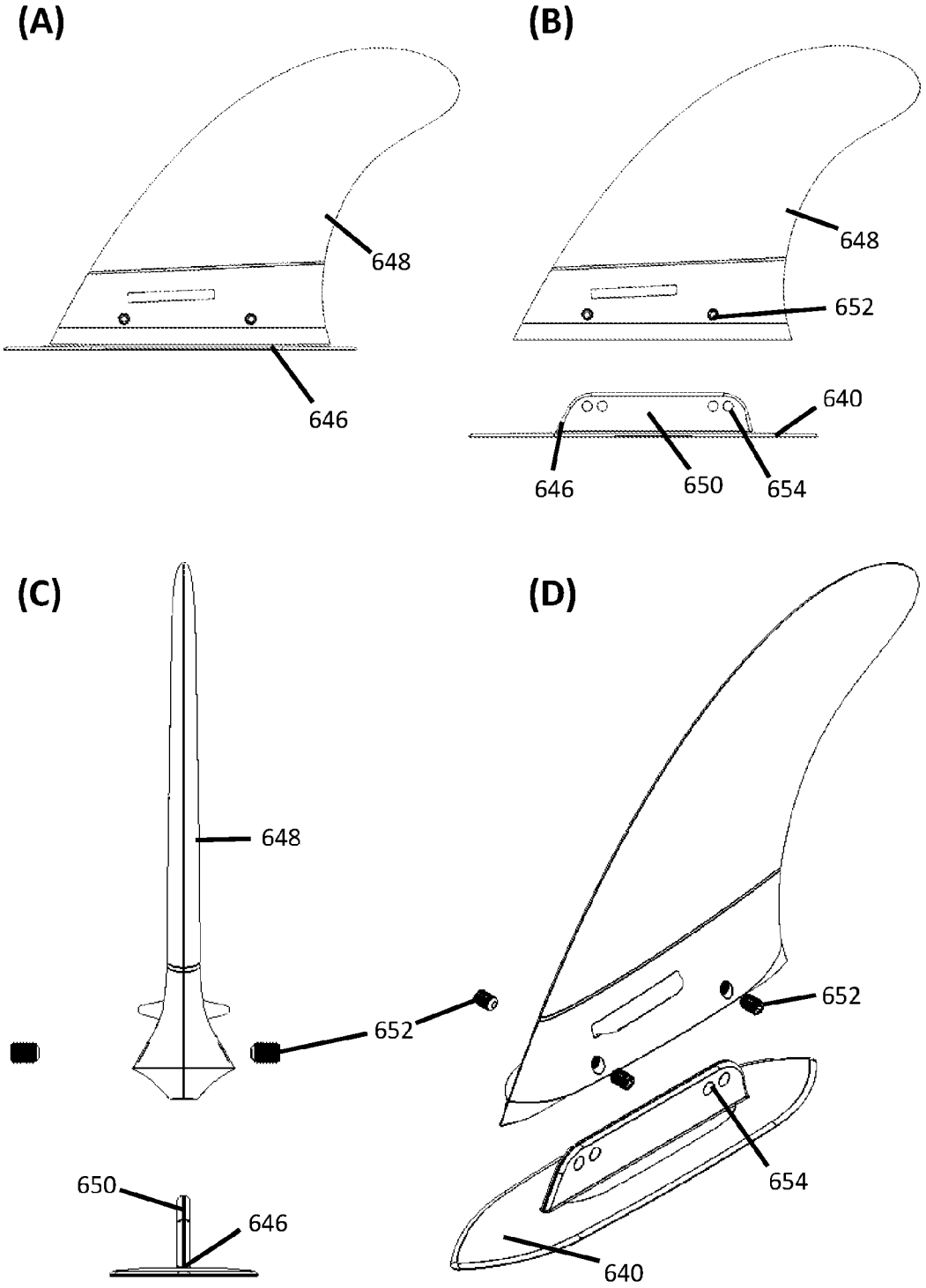
FIG. 17. illustrations showing (A) a port side view, (B) exploded port side view, (C) exploded front view, and (D) exploded top perspective view, of an adjustable version of a preferred embodiment of a fin according to the invention with a base attachment surface for mounting the fin to the bottom surface of a surfboard.

FIG. 17 shows a detachable and adjustable version of the fin of FIG. 5. The fin comprises a base portion 646 engaging a fin section 648 to form the detachable and adjustable fin, wherein a planar member 650 attached to the base attachment plate 640 to form the base portion 646 is located within an internal cavity within the fin section 648. The planar member 650 is secured to the fin section 648 within the internal cavity by screws 652 that are accessible from the outer fin surfaces and pass through the fin section 648 into the internal cavity and can engage with the planar member 650 at locking cavities 654. To adjust the position of the fin section 648 relative to the base portion 646, screws 652 are unscrewed out of a set of locking cavities 654 at a first locking position, thereby un-securing the fin section 648 from the base portion 646, the fin section 648 is slidably moved toward the leading edge or trailing edge, and the screws 652 are screwed into locking cavities 654 at a second locking position, thereby re-securing the fin section 648 to the base portion 646 at the second position. The more locking cavities 654 on the planar member 650, the more locking positions are available for adjusting the fin section 648 relative to the base portion 646.

Removing the screws 652 also enables the fin section 648 to be removed and separated from the base portion 646. This can be beneficial for transporting a surfboard to which the base portion 646 is permanently attached so that the fin section 648 is not damaged or in the way when stacking boards or other equipment on top of the surfboard. It also allows a fin section 648 to be replaced by a fin section of, for example, a different shape, size, colour, material, amongst others as the user requires or if the fin section 648 on the board becomes damaged.

A detachable fin according to the invention may or may not also be adjustable in a direction towards the leading edge or trailing edge of the fin. Likewise, an adjustable fin according to the invention may or may not be detachable in the fin section being separable from the base.

Figure 18:
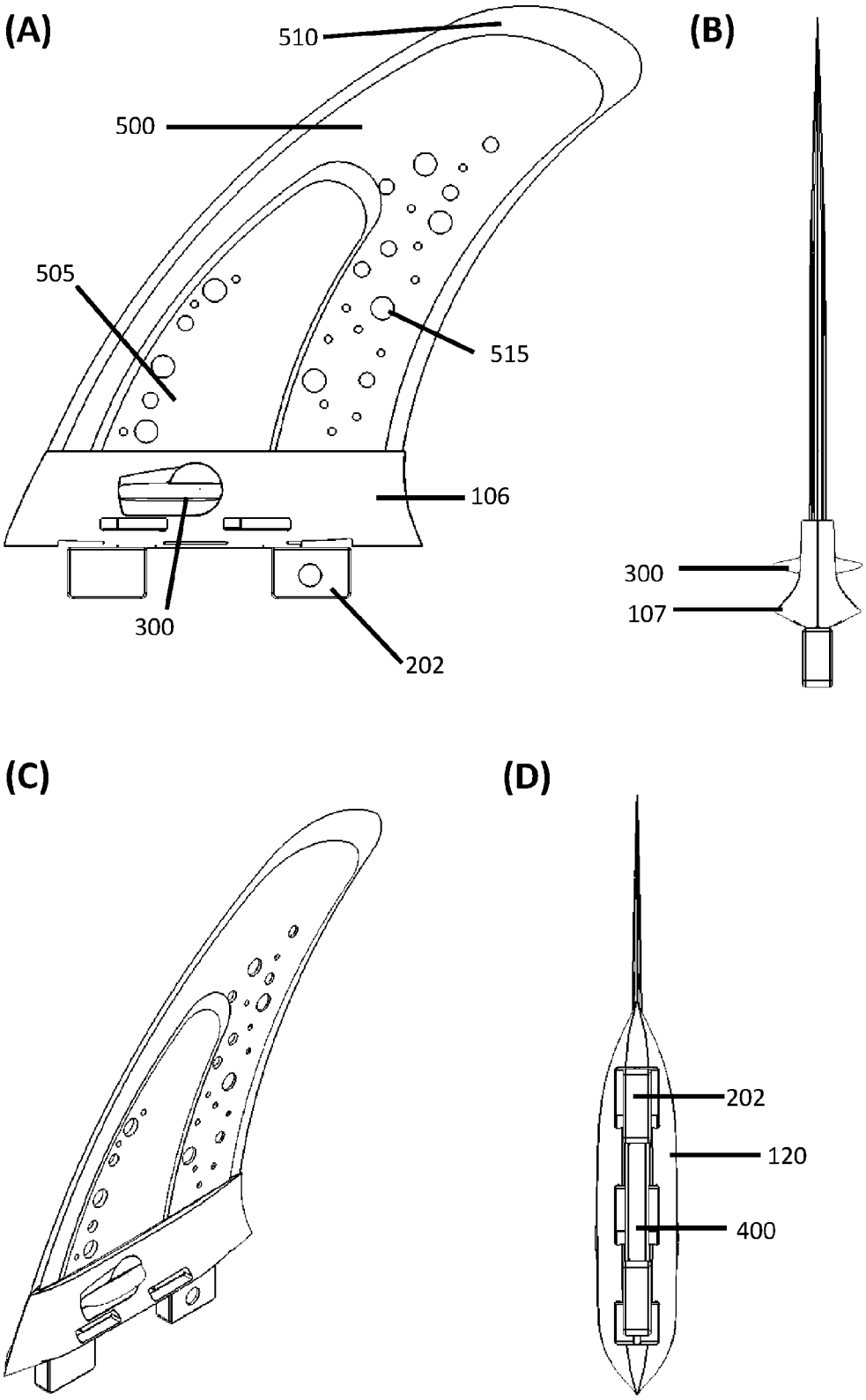
FIG. 18. is an illustration showing (A) a side view, (B) a front view, (C) a perspective view, and (D) a bottom view, of a further adjustable version of a preferred embodiment of a fin according to the invention. Mount comprises mounting blocks which attach to FCS® fin plugs.
Figure 19:
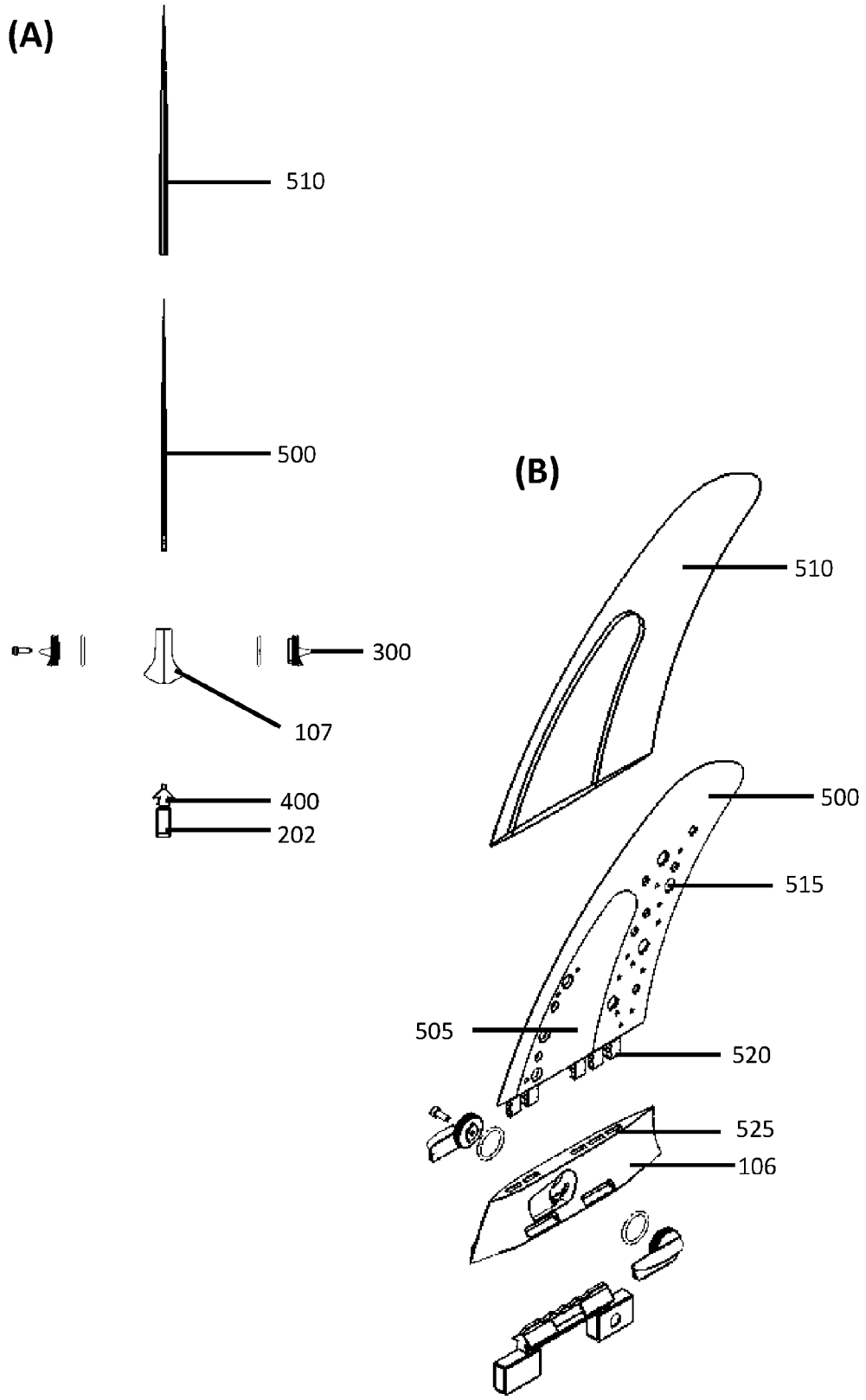
FIG. 19. is an illustration showing (A) an exploded front view, and (B) an exploded perspective view, of the embodiment shown in FIG. 18.

FIG. 18 shows collapsed views and FIG. 19 shows exploded views of a further detachable and adjustable version of an embodiment of the fin of the invention, wherein the base comprises mounting blocks 202 that can attach to FCS® fin plugs for mounting the fin onto a surfboard. In this embodiment, the knob 300 comprises the minor ridge. The outer fin surface 106 adjacent to the base of the fin forms main ridge on either side 107 as in the non-adjustable version of the fin of the invention.

This embodiment further comprises an upper fin section attached to the bottom portion of the fin section, the upper fin section comprising a titanium alloy (comprising approximately 4% vanadium and approximately 6% aluminium) upper fin 500 covered with an overmolding 510 of protective safety polymer. The titanium alloy upper fin section is up to approximately 2 mm to 2.5 mm thick in the widest section 505.

The upper fin 500 shown in FIG. 19B comprises upper fin attachment members 520 which are received and restrained in cavities 525 to attach the upper fin 500 to the bottom portion of the detachable and adjustable fin. Adhesive may be used to restrain the upper fin attachment members 520 in the cavities 525. The embodiment shown in FIG. 14B comprises 5 upper fin attachment members 520 and 5 matching cavities 525. However, more or less than 5 upper fin attachment members may be used, and they may comprise a variety of different shapes and sizes with matching cavities that can receive and restrain the members.

The upper fin 500 shown in FIG. 18A also comprises circular holes 515 or cut outs of various sizes. These cut outs reduce the weight of the upper fin 500 further and assist in providing the beneficial flex characteristics for the detachable and adjustable fin of the invention. While the cut outs are circular in this embodiment, they may comprise a variety of different shapes.

Across the profile of the upper fin section is varying thickness to create a single or double sided fin foil as is known in the art and common to the shapes of surfboard fins, with a thicker section 505 toward the leading edge of the fin section which decreases in thickness with closer proximity to the trailing edge.

In the embodiment of the detachable and adjustable fin shown in FIGS. 15 and 16 and as shown in FIG. 19A, the base 400 and mounting blocks 202 form one piece and do not comprise separate components that have been attached. Thus, the base can be separated from the fin section with the base left attached to a surfboard or removed from the surfboard.

Figure 20:
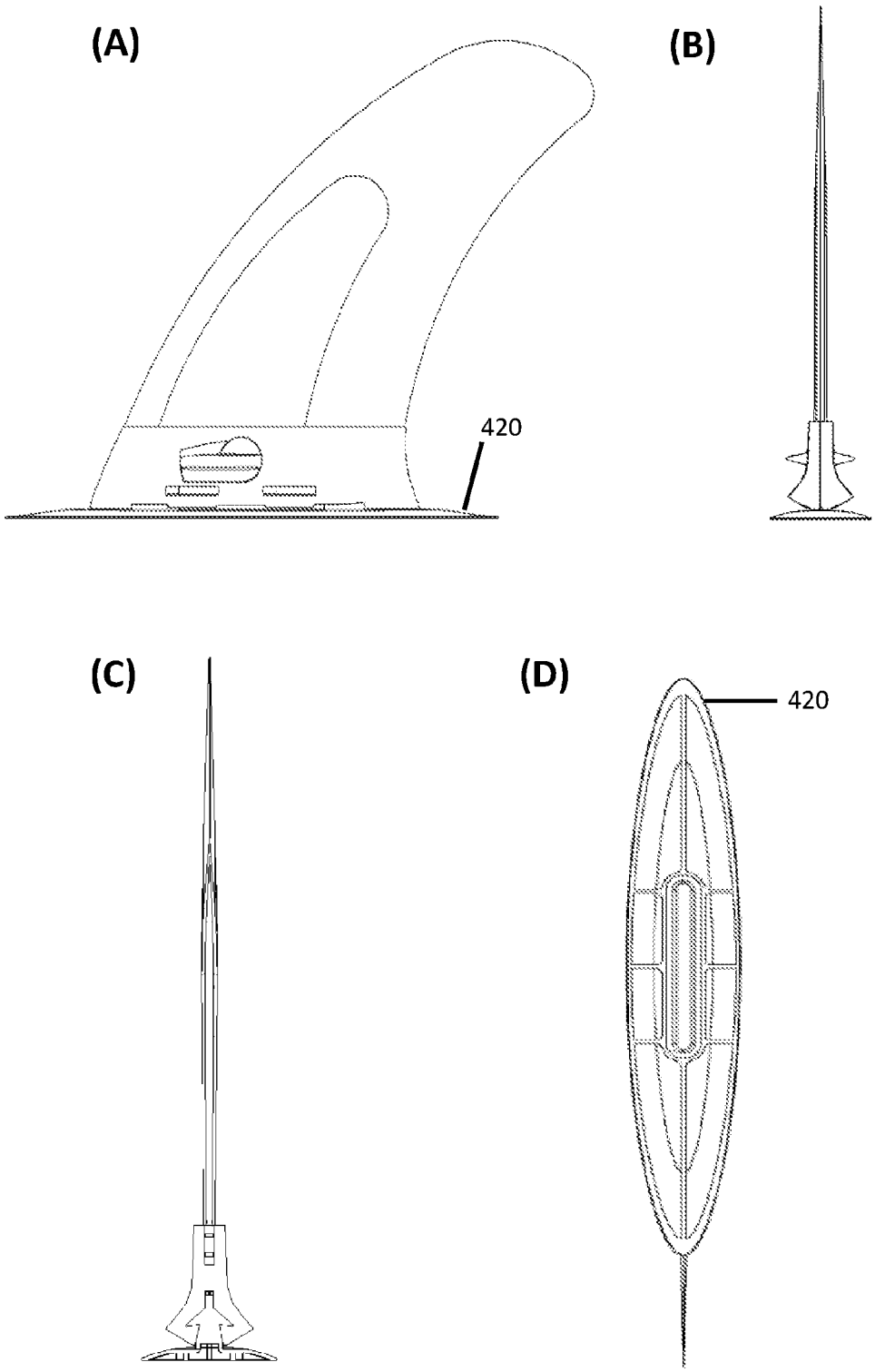
FIG. 20. is an illustration showing (A) a side view, (B) a front view, (C) a cross sectional front view, and (D) a bottom view, of a further adjustable version of a preferred embodiment of a fin according to the invention.
Figure 21:
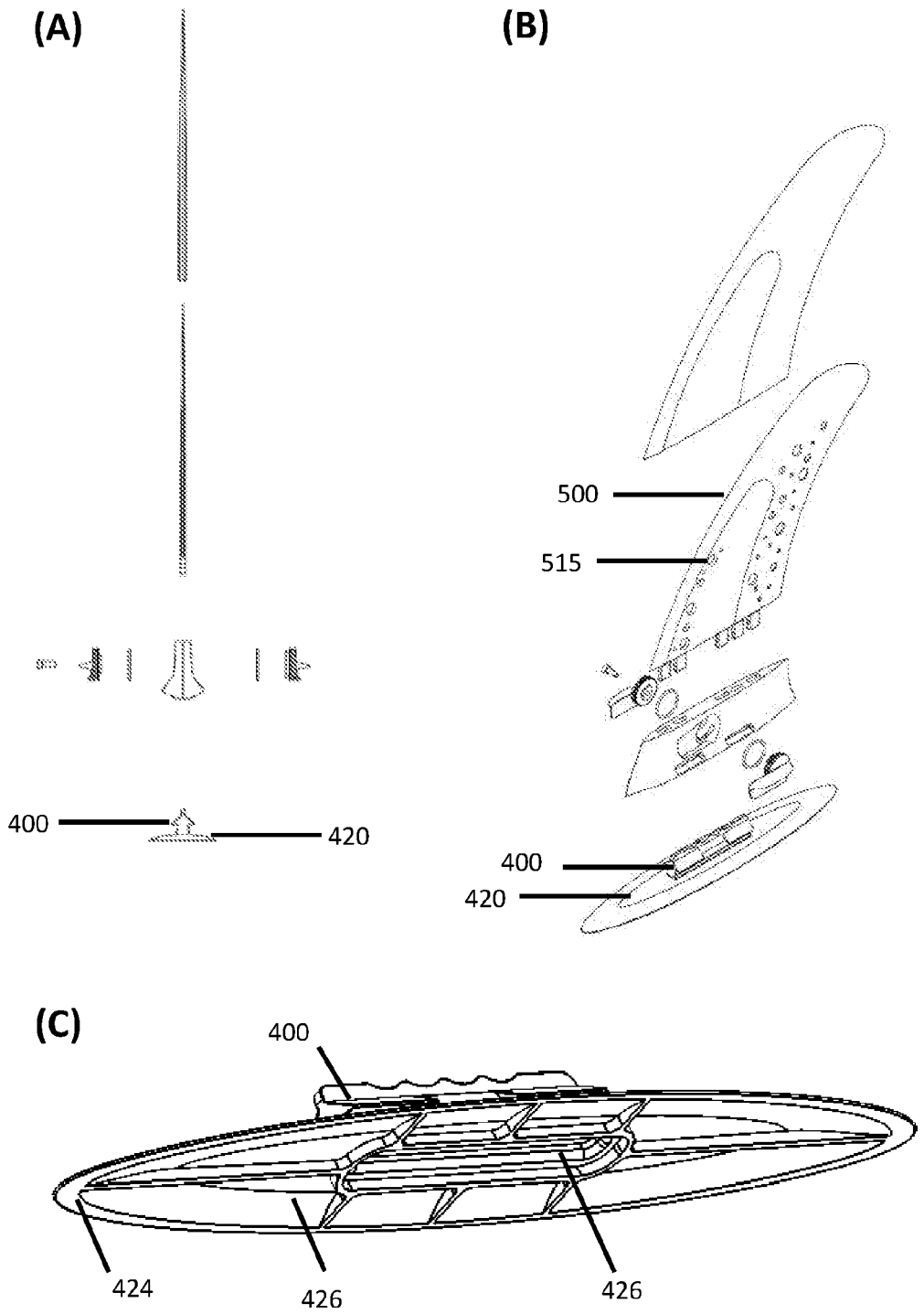
FIG. 21. is an illustration showing (A) an exploded front view, (B) an exploded perspective view, and (C) an underside perspective view (of the base) of the fin shown in FIG. 20.

A further detachable and adjustable version on an embodiment of a fin according to the invention is shown in a collapsed form in FIG. 20, and an exploded form in FIG. 21. This embodiment is similar to the embodiment of the detachable and adjustable fin in FIGS. 18 and 19 with the exception that instead of mounting blocks attached to the base, the base 400 is attached to a base attachment plate 420 for mounting onto the external bottom surface of a surfboard with adhesive and/or rovings, screws or other mechanical attachment means. Thus, similar to the fin of FIG. 17, the fin section can be removed from the base for storage, transport, or replacement of the fin section with a new fin section of the same or different template, shape, size, and/or material.

The underside of the base plate is shown in FIG. 21C showing the base attachment surface 424 and large recesses or cavities 426 for accommodating adhesive.

Figure 22:
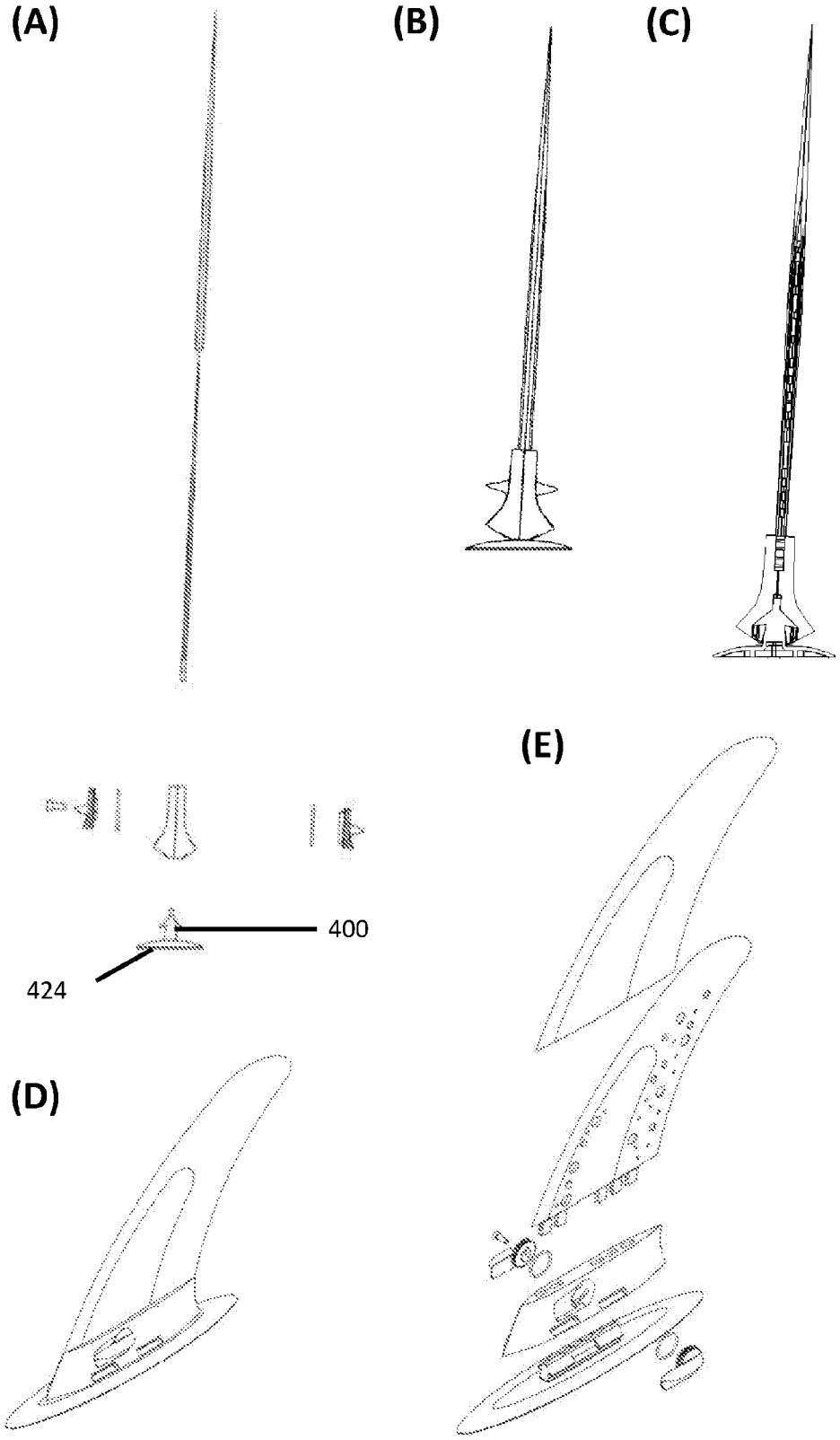
FIG. 22. is an illustration showing (A) an exploded front view, (B) a front view, (C) a cross sectional front view, (D) a perspective view, and (E) an exploded perspective view, of a further adjustable version of a preferred embodiment of a fin according to the invention.

When mounted to a surfboard, the base of the embodiment of the detachable and adjustable fin of FIGS. 20 and 21 points away from the surfboard at an angle of approximately 90 degrees when measured from the external bottom surface of the surfboard on to which it is mounted. While being otherwise the same as the embodiment of FIGS. 20 and 21, the base of the embodiment of FIG. 22 points away from the surfboard at an angle of approximately 86.5 degrees (or approximately 3.5 degrees off 'centre' or 90 degrees) when measured from the external bottom surface of the surfboard on to which it is mounted, i.e. at a different cant. That is, the base 400 is 3.5 degrees off pointing in a direction perpendicular to the base attachment surface 424.

Figure 23:
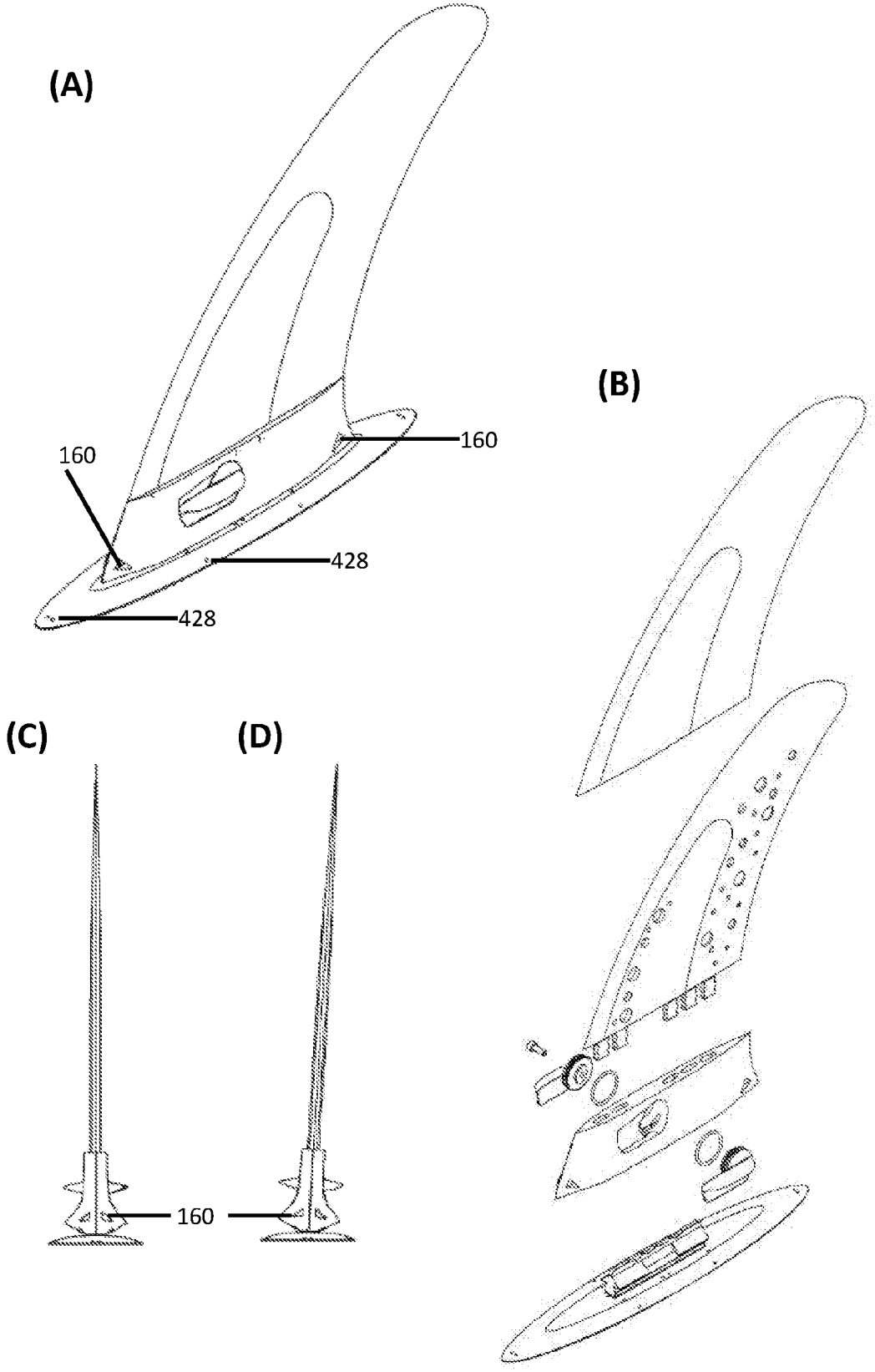
FIG. 23. is an illustration showing (A) a perspective view (B) an exploded perspective view, and (C) a front view, of a further adjustable version of a preferred embodiment of a fin according to the invention; and (D) a front view, of a further adjustable version of a preferred embodiment of a fin according to the invention.

A further detachable and adjustable version of a preferred embodiment of a fin according to the invention is shown in FIG. 23. This embodiment is similar to the embodiment shown in FIGS. 20 to 22 with a key difference that side shut-off cavities have been replaced with front and rear facing shut-off cavities 160. Another key difference is the presence of injection conduits 428 for injecting adhesive into the cavities or releasing air from the cavities as the adhesive fills the cavities 428, and/or for use as screw holes for attaching the detachable and adjustable fin to a surfboard with screw-type fasteners such as screws.

Figure 24:
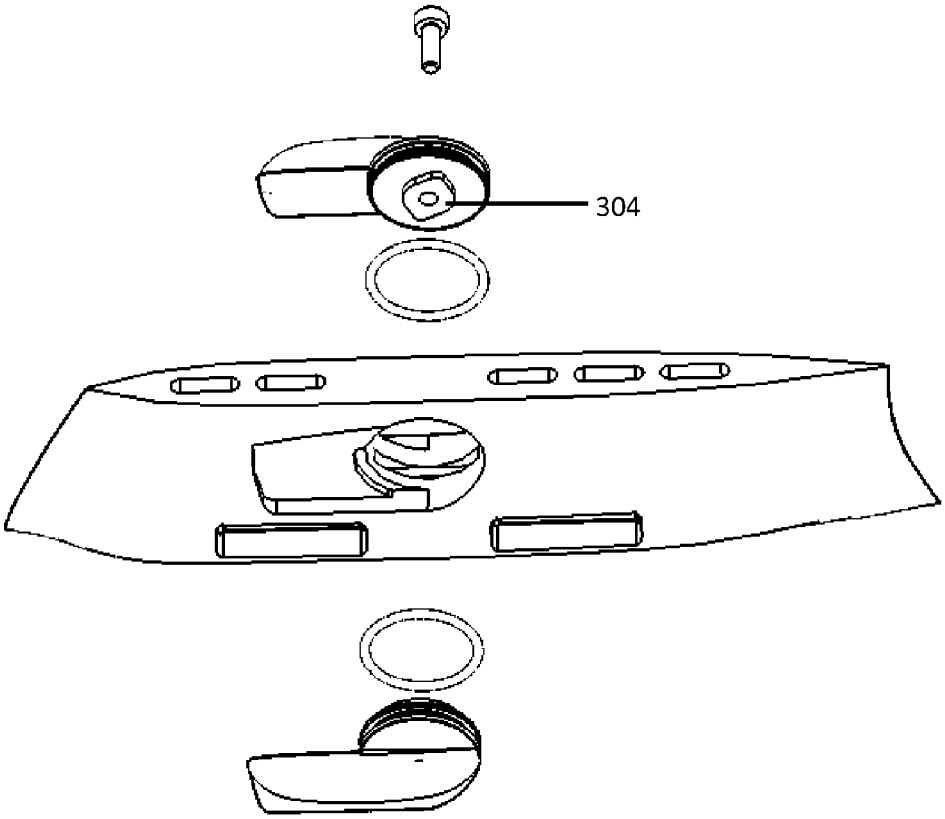
FIG. 24. is an illustration showing (A) an exploded side perspective view, and (B) an exploded side perspective view, of the bottom portion of the fin section of the embodiment shown in FIGS. 18 to 23.
Figure 24:
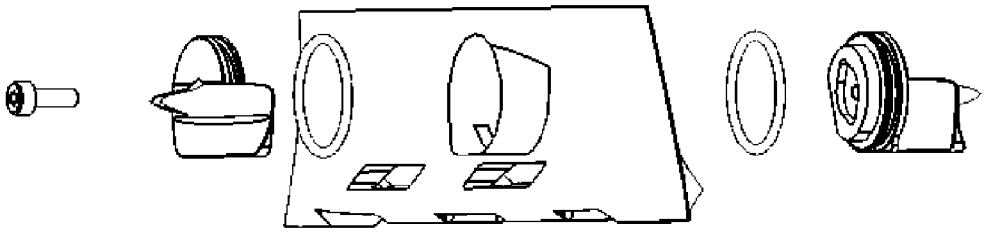

An exploded view of the parts of the lock used in some adjustable versions of preferred embodiments described herein is shown in FIG. 24. The lock, which may also be referred to as a "locking means", comprises a cam 304.

Propeller for Watercraft Propulsion

Figure 25:
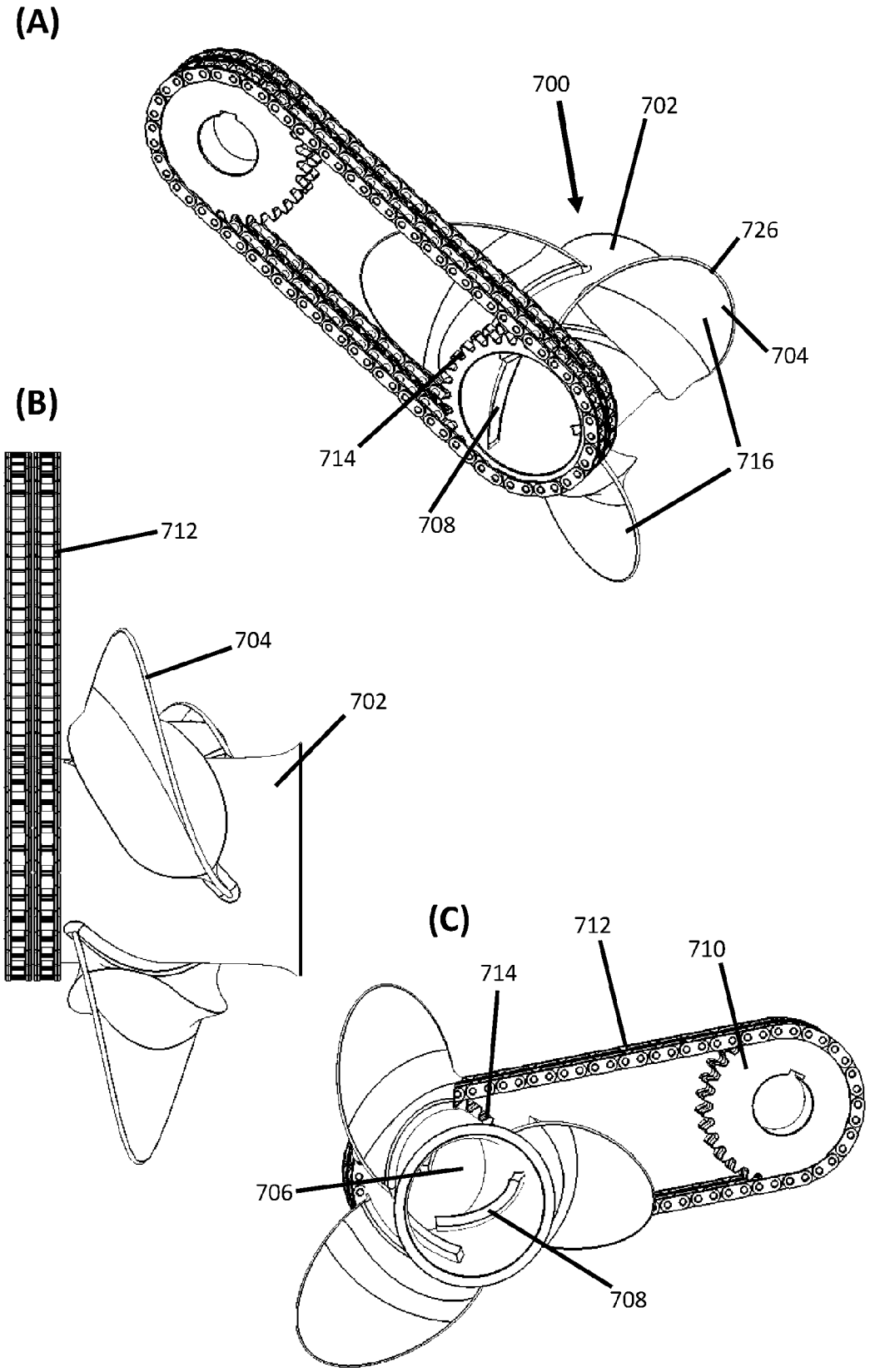
FIG. 25. is an illustration showing (A) a front perspective view, (B) a side view, and (C) a rear perspective view from above, of a preferred embodiment of a propeller according to the invention.
Figure 26:
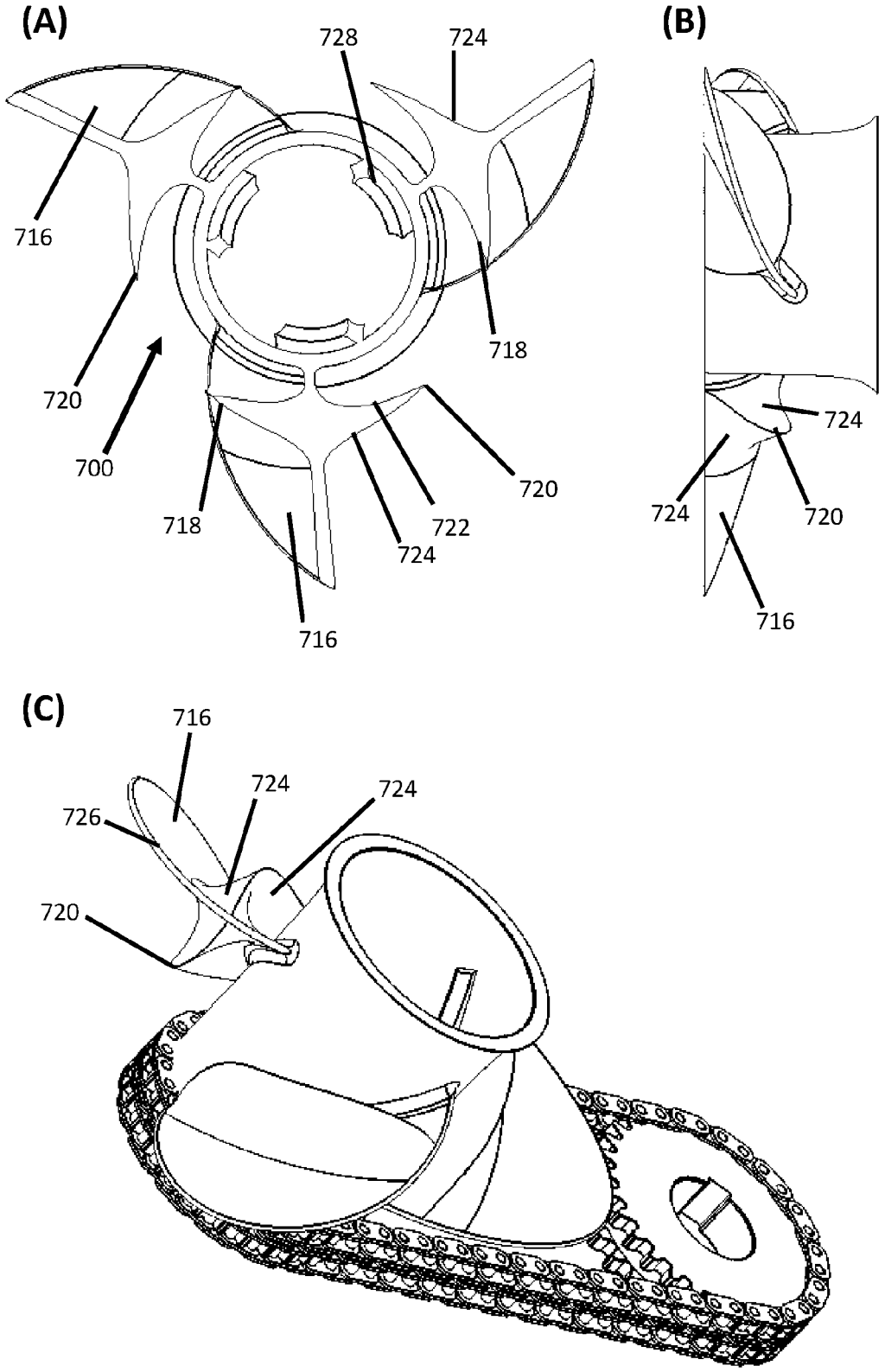
FIG. 26. is an illustration showing (A) a cross-sectional front view, (B) a cross-sectional side view, and (C) a rear perspective view from below, of a preferred embodiment of a propeller according to the invention.

A preferred embodiment of a propeller 700 for providing propulsion through water is shown in FIG. 25 and FIG. 26. The propeller 700 combines features and benefits of a propeller and an impeller. In this respect, a propeller assists a vessel to move through water by providing a thrust force. The propeller 700 comprises a revolving hub 702 with rotating propeller blades 704 that convert rotational motion into forward thrust. This is due to the pressure differential that is created between the front and rear surfaces of the propeller blades 704. This pressure differential pushes water behind the propeller blade 704 in accordance with Newton's laws of motion and Bernoulli's theorem.

An aperture 706 through the hub 702 comprises impeller blades 708 that rotate with the revolving of the hub 702 to create a sucking force to draw water through the aperture therein increasing the pressure of the fluid and thus its flow through the aperture 706.

The combined forward thrust provided by the rotating propeller blades 704 and impeller blades 708 forces the propeller 700 of the invention through the water and the vessel to which it is attached.

The rotational force applied to the propeller 700 of this preferred embodiment is via a motor which turns a sprocket 710 interlocking with a first end of a loop of roller chain 712. At a second end, the loop of roller chain 712 interlocks with teeth 714 on the hub 702, and the turning of the sprocket 710 by the motor therein rotates the loop of roller chain causing the propeller 700 to also rotate.

The propeller blades 704 comprise outer blade surfaces 716. A ridge 718 protrudes generally laterally from each outer blade surface 716 as shown in the cross-sections of FIG. 26A. At the crest of each ridge 718 is a ridgeline 720 which comprises a relatively sharp edge. Each side of the ridge 718 between the ridgeline 720 and where the ridge 718 protrudes from the outer blade surface 716 is a curved sloped inner ridge surface 722 adjacent and facing the hub 702, and a curved sloped outer ridge surface 724. These sloped inner ridge surfaces 722 and outer ridge surfaces 724 comprise curved portions, substantially flat portions, and comprise steeper curves where ridge 718 meets outer blade surface 716.

The inner surfaces 722 of the lateral ridges 716, and the ridgeline 720 comprise a similar curve to the curved shape of the hub 702. The end of the ridgelines 720 meet at the blade edge 726. The blade edges 726 and ridgelines 720 are relatively sharp edges which assist in cutting through the water.

Figure 27:
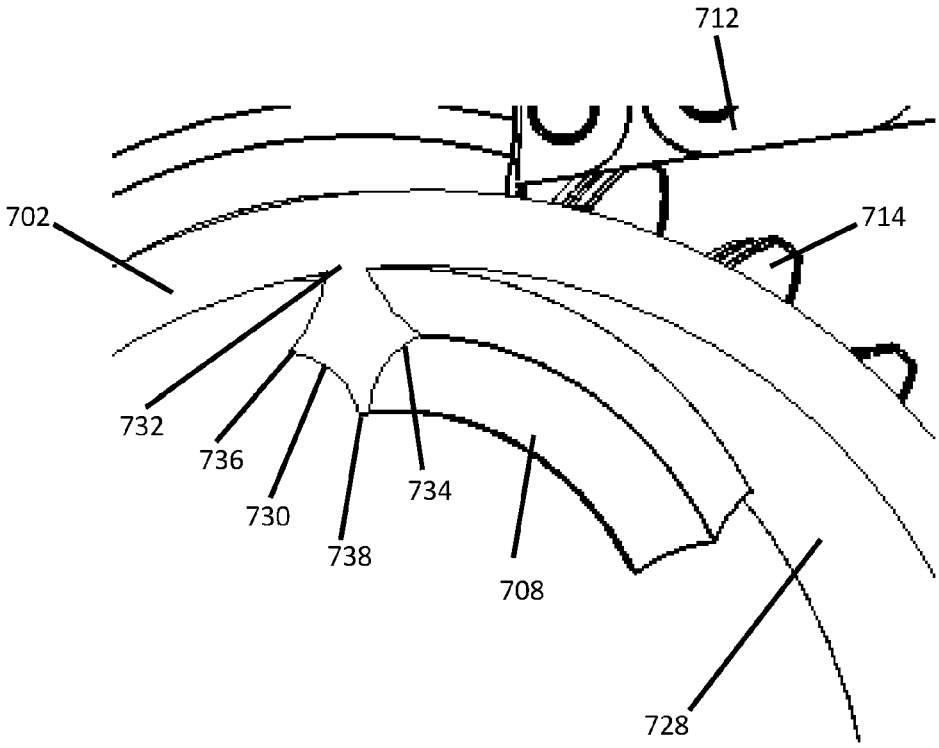
FIG. 27. is an illustration showing a portion of a front view cross-section, of a preferred embodiment of a propeller according to the invention.

The impeller blades 708 are relatively short blades compared to the propeller blades 704. The impeller blades 708 on the inner aperture surface 728 of the hub 702 are curved (spirally similarly to rifling in a barrel) assists to cause water passing through the aperture 706 and the impeller blades 708 to spiral in the direction of the revolving hub 702. A cross-section of the impeller blades 708 as shown in FIG. 26 and FIG. 27 shows an almost diamond-shape with concave impeller blade surfaces 730 and a wide impeller base 732 where the impeller blade 708 meets the inner aperture surface 728. This cross-section of the impeller blade 708 may also be considered as also showing two lateral impeller ridges 734 protruding from the sides of the impeller blade 708 with concave sloped impeller blade surfaces 730 either side of the impeller ridgelines 736. The impeller ridgelines 736 are at substantially right angles or at right angle planes to the centreplane of the impeller blade 708, the centreplane from between the middle of the impeller base 732 where it meets the inner aperture surface 728, to the impeller blade tip 738.

Keels

Figure 28:
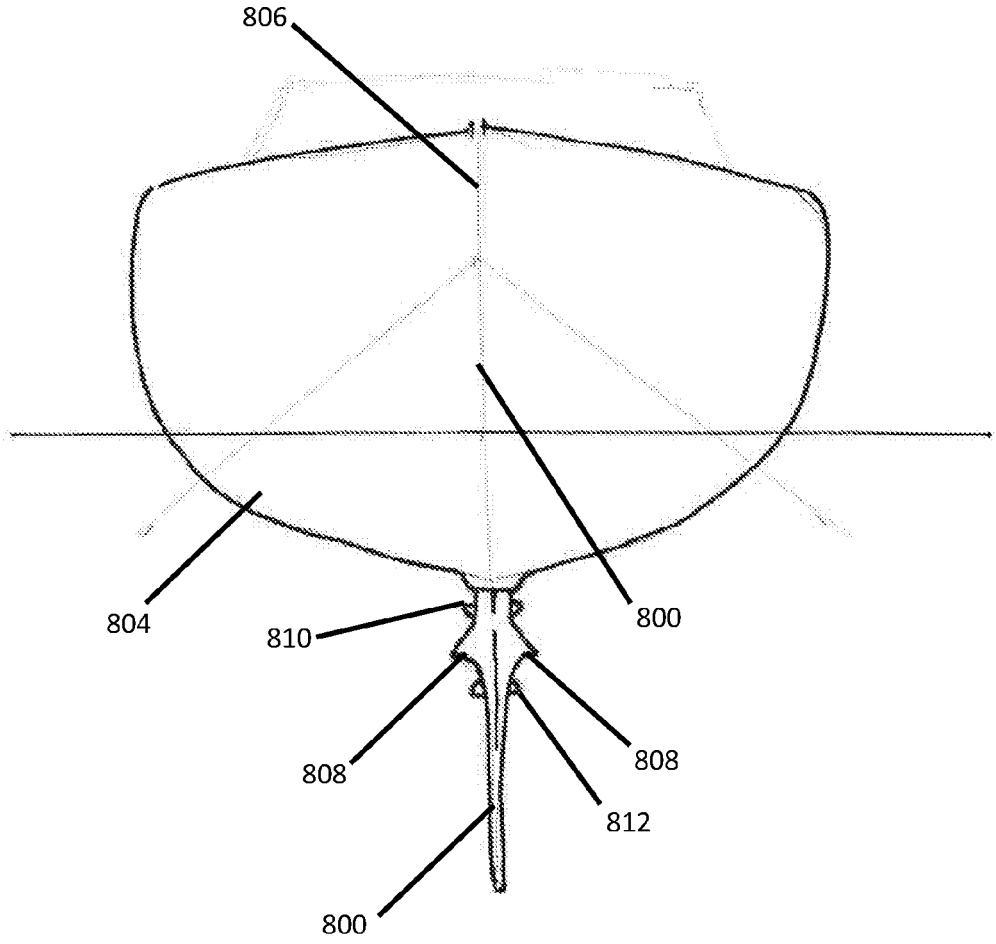
FIG. 28. is an illustration showing a partial front view of a boat comprising a keel according to a preferred embodiment of the invention.
Figure 29:
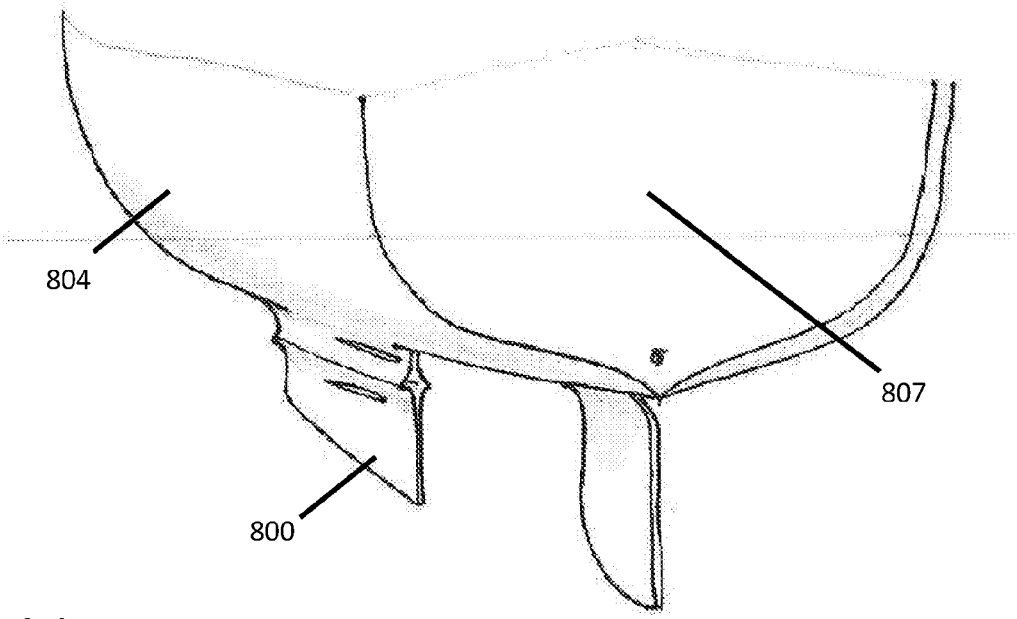
FIG. 29. is an illustration showing (A) a partial rear perspective view of a boat comprising a keel according to a preferred embodiment of the invention, and (B) a partial rear perspective view of the keel.
Figure 29:
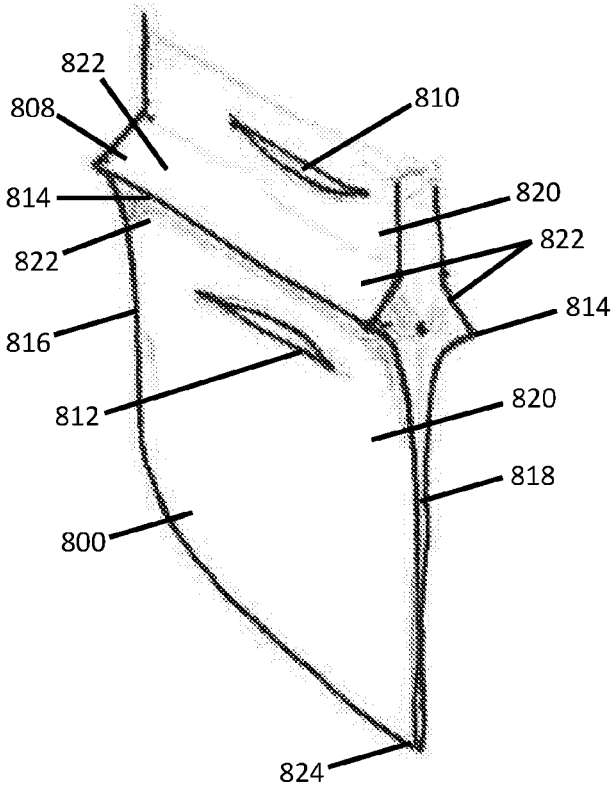

A preferred embodiment of a keel of a boat (or yacht) according to the invention is shown in FIG. 28 and FIG. 29. The keel 800 of this embodiment is located in the common location for a fin keel on a boat, projecting below the centreplane 802 of the vessel hull 804, the centreplane 802 between bow 806 and stern 807 of the boat.

The keel 800 comprises two main ridges 808 protruding laterally from the sides of the keel 800 adjacent where the keel 800 meets the vessel hull 804. An upper minor ridge 810 protrudes laterally from each side of the keel 800 just above the main ridges 808. A lower minor ridge 810 protrudes laterally from each side of the keel 800 just below the main ridges 808.

The rear 818 of the keel in FIG. 29B shows the diamond-like shape with elongated top and bottom ends produced by the main ridges 808 in the keel 800. At the crest of each main ridge 808 is a ridgeline 814. As is shown in FIG. 29, the main ridges 808 and the ridgelines 814 extend from the front 816 of the keel where they meet, to the rear 818 of the keel where they end at the flat surface of the rear 818 of the keel 800. In other embodiments, the ridgelines 814 may meet at the rear 818 of the keel 800 where the rear 818 of the keel 800 ends along an edge similar to the front 816 of the keel 800.

Each side of the ridge 808 between the ridgeline 814 and where the ridge 808 protrudes from the outer keel surface 820 is a curved sloped ridge surface 822. These sloped ridge surfaces 822 may comprise curved portions, substantially flat portions, and steeper curves near the ridgelines 814 and/or where main ridge 808 meets the outer keel surfaces 820.

The ridgelines 814 of the main ridges 808 are at substantially right angles or at right angle planes to the centreplane 826 of the keel 800 (see, for example, FIG. 30), the centreplane comprising a plane from between the middle of the keel 800 where it meets the vessel hull 804, to the keel tip 824.

The upper minor ridge as shown in FIG. 29B comprises a configuration similar to a flat foil protruding from each side of the outer keel surface 820 adjacent where the outer keel surface 820 meets the sloped ridge surfaces 822 above the main ridges 808 (see for example, FIG. 30B). The flat side of the flat foil configuration for the upper minor ridge faces up whilst the more curved side of the upper minor ridge faces down.

The lower minor ridge 812, is a similar shape and configuration to the upper minor ridge 810 except the flat foil shape of the lower minor ridge has the flat side facing down away from the vessel hull 804.

The upper minor ridge 810 and lower minor ridge 812 extend only part way between front 816 and rear 818 of the keel 800.

While these upper minor ridges 810 and lower minor ridges 812 of the preferred embodiment comprise a configuration of a flat foil, the upper and lower minor ridges may be differently shaped or not even present in other embodiments of the keel of the invention. For example, the upper and lower ridges may not be present; or one or both of the upper or lower ridges may be present; the upper and/or lower ridges may extend from the front 816 of the keel 800 to the rear 818; or the upper and/or lower ridges may comprise more evenly shaped ridges similar to, though smaller, than the main ridges 808. The upper minor ridges and/or lower minor ridges may comprise relatively sharp ridgelines at their crest, or they may comprise rounded, or even squared edges, or a combination of both or other shapes at their ridgelines. The upper minor ridges and/or lower minor ridges may also not comprise flat foil shapes, but comprise more even configurations with similar or the same sloped sides either side of straight or (curved) ridgelines on the upper minor ridges and/or lower minor ridges. The upper minor ridges and/or lower minor ridges may be similarly shaped or may comprise different shapes.

Figure 30:
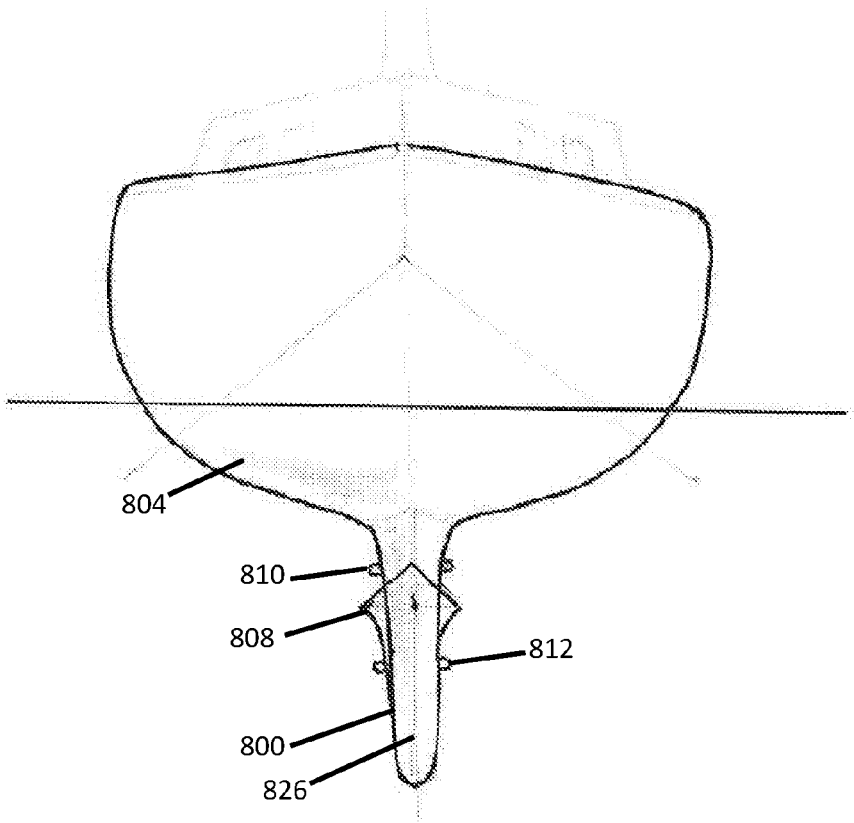
FIG. 30. is an illustration showing (A) a partial front view, and (B) a partial side view, of a boat comprising a keel according to a preferred embodiment of the invention.
Figure 30:
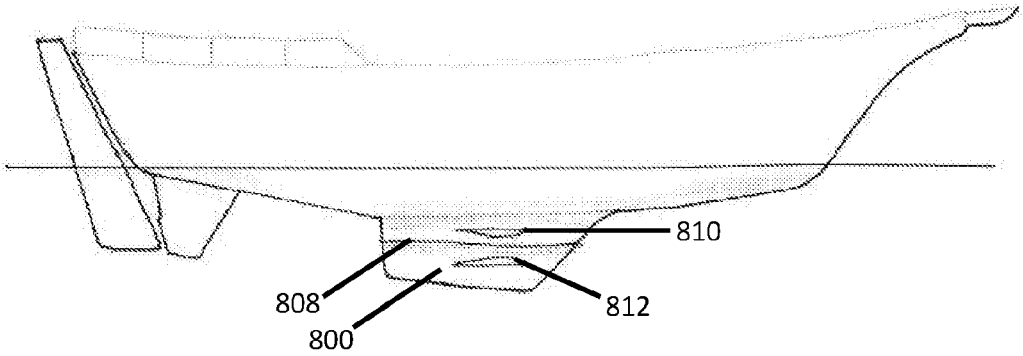

While a fin keel according to the invention is shown in FIG. 28 and FIG. 29, the keel according to the invention may be another type of keel, for example, a full keel or ballast keel, a skeg, bilge keel, deep keel, dagger board, lee board, centre board, pivot board, winged keel, twin canting keel, folding keel, or lifting keel, amongst others. In this respect, the keel according to the invention shown in FIG. 30 is a full or ballast keel. A keel according to the invention may have one or more ridges only on one side surface, for example if it used on one side of the boat.

Figure 31:
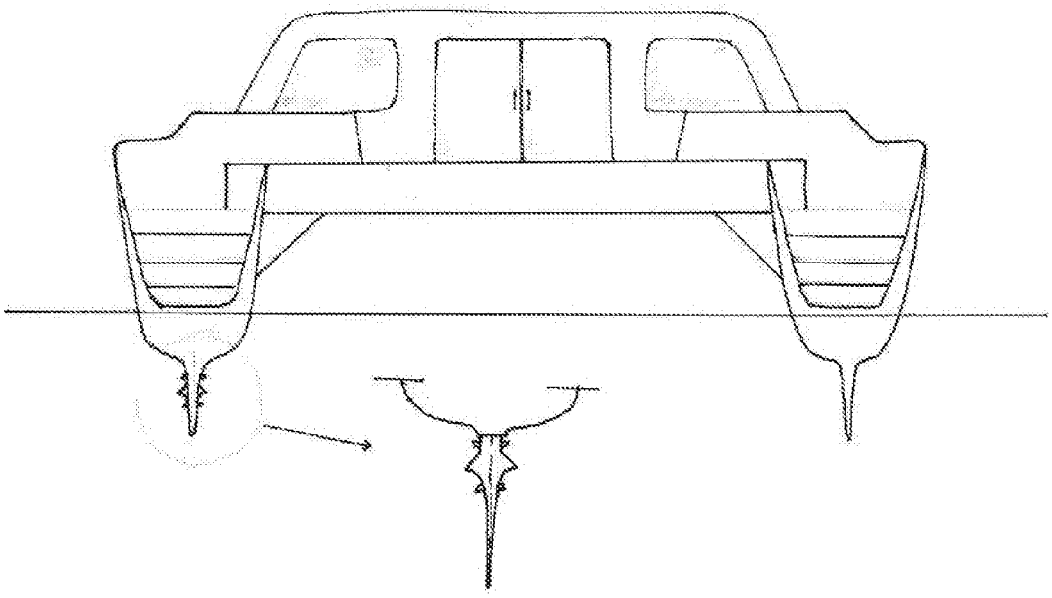
FIG. 31. is an illustration showing (A) a rear view, and (B) a partial side perspective view, of a catamaran comprising keels according to a preferred embodiment of the invention.
Figure 31:
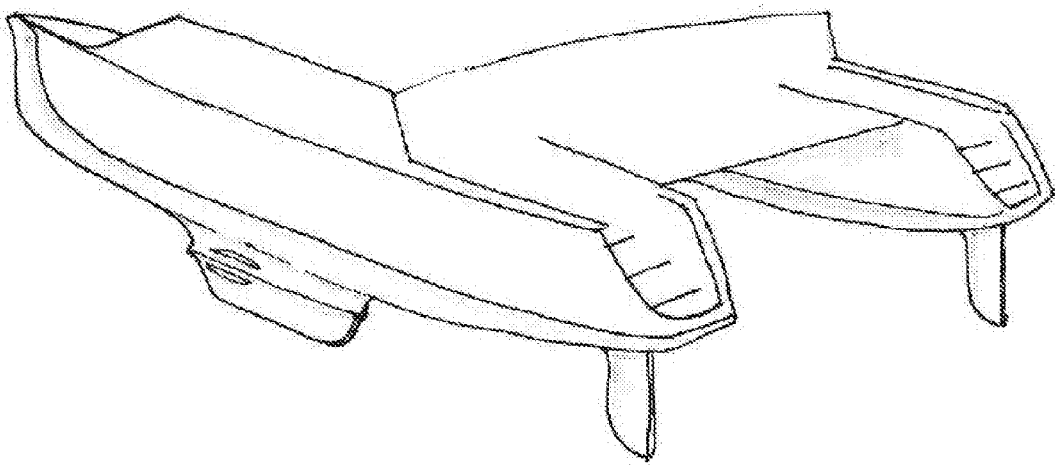

A catamaran or trimaran may use the keel according to the invention on the bottom of one or more hulls as shown in FIG. 31.

The invention claimed is:

1. A fin for use on a propeller or impeller, the fin comprising:

a leading edge, a trailing edge, and a base, the base comprising at least one mount for mounting the fin onto a propeller or impeller;

a first and a second outer fin surface which meet along the leading edge and the trailing edge and abut the base;

a first ridge protruding laterally from the first outer fin surface, and a second ridge protruding laterally from the second outer fin surface, a third ridge protruding laterally from the first outer fin surface, and a fourth ridge protruding laterally from the second outer fin surface;

wherein the third ridge and the fourth ridge are smaller and located further from the base than the first ridge and the second ridge.

2. A fin according to claim 1, wherein the distance of the first ridgeline or the second ridgeline to the base is between approximately 4% and 8% of the distance of the base to the tip of the fin.

3. A fin according to claim 1 wherein the first ridge protrudes laterally from the first outer fin surface, or the second ridge protrudes laterally from the second outer fin surface, to a maximum distance from the centreplane of between 2 to 4.5 times greater than the maximum distance of the centreplane to a non-ridged portion of the first outer fin surface, wherein the centreplane passes through the leading edge and trailing edge of the fin.

4. A fin according to claim 1, wherein the first ridge and the second ridge are located equidistant from the base.

5. A fin according to claim 1, wherein the first ridge comprises a first ridgeline, and the second ridge comprises a second ridgeline, and the first and second ridgelines are on a plane substantially parallel to the base and/or on adjacent surface of the propeller or impeller to which the fin is mounted.

6. A fin according to claim 1, wherein the first ridge comprises first ridge sides, and the second ridge comprises second ridge sides, and the third ridge comprises third ridge sides, and the fourth ridge comprises fourth ridge sides, and at least a portion of the first ridge sides or second ridge sides or third ridge sides or fourth ridge sides comprise concave, convex, and/or flat portions.

7. A fin according to claim 5, wherein the first ridgeline or second ridgeline end at the leading edge.

8. A fin according to claim 1, wherein the third or fourth ridges are on a plane that is substantially parallel to the base, or a plane that is substantially parallel to an adjacent surface of the propeller or impeller.

9. A fin according to claim 1, wherein the third ridge protrudes laterally from the first outer fin surface, or the fourth ridge protrudes laterally from the second outer fin surface, to a maximum distance from the centreplane of between 1.5 to 6 times greater than the maximum distance of the centreplane to a non-ridged portion of the first outer fin surface, wherein the centreplane passes through the leading edge and trailing edge of the fin.

10. A fin according to claim 1, wherein the third ridge and the fourth ridge are located equidistant from the base.

11. A fin according to claim 1, wherein the fin is an adjustable fin comprising:

a base comprising:

a mount for attaching the fin to a propeller or impeller; and an insert member extending in a direction contrary to the mount;

a fin section comprising:

two outer fin surfaces which meet at a leading edge and a trailing edge comprising the first and the second outer fin surfaces;

an underside surface comprising an opening to an internal cavity within the fin section, the internal cavity within the fin section configured to house the insert member of the base and enable slidable movement of the insert member in a direction towards the leading edge or the trailing edge; and a lock that is manipulable, wherein the lock can releasably couple to the insert member at one of two or more locking positions thereby preventing slidable movement of the insert member;

wherein the fin section is configured to adjust relative to the base by manipulating the lock to uncouple the lock from the insert member at a first locking position, slidably moving the insert member through the internal cavity, and releasably coupling the lock to the insert member at a second locking position.

12. A fin according to claim 1, wherein the fin is a detachable fin comprising:

a base comprising:

a mount for attaching the fin to a propeller or impeller; and an insert member extending in a direction contrary to the mount;

a fin section comprising:

two outer fin surfaces which meet at a leading edge and a trailing edge comprising the first and the second outer fin surfaces;

an underside surface comprising an opening to an internal cavity within the fin section, the internal cavity within the fin section configured to house the insert member of the base; and a lock that is manipulable, wherein the lock can releasably couple to the insert member thereby preventing movement of the fin section relative to the base;

wherein the fin section is uncoupled and detached from the base by manipulating the lock to uncouple the lock from the insert member.

13. A fin according to claim 5, wherein the distance of the first ridgeline or the second ridgeline to the base is between approximately 1% and 15% of the distance of the base to the tip of the fin.

14. A fin according to claim 5, wherein the first ridgeline or second ridgeline end at the trailing edge.

15. A fin for use on a propeller or impeller, the fin comprising:

a leading edge, a trailing edge, and a base, the base comprising at least one mount for mounting the fin onto a propeller or impeller;

a first and a second outer fin surface which meet along the leading edge and the trailing edge and abut the base;

a first ridge protruding laterally from the first outer fin surface, or a second ridge protruding laterally from the second outer fin surface, and a third ridge protruding laterally from the first outer fin surface, or a fourth ridge protruding laterally from the second outer fin surface;

wherein the third ridge or the fourth ridge is smaller and located further from the base than the first ridge or the second ridge.

* * * * *